US006364154B2

(12) United States Patent
Kruzick et al.

(10) Patent No.: US 6,364,154 B2
(45) Date of Patent: Apr. 2, 2002

(54) WASTE HANDLING INTERMODAL CONTAINER WITH SLIDING LID, SIDE-HINGED, END-MOUNTED DUMP DOOR AND SWING-AWAY HEADER

(75) Inventors: Kent Kruzick, Winamac; Dann Bailey, Sr., Knox, both of IN (US)

(73) Assignee: Galbreath, Inc., Winamac, IN (US)

( * ) Notice: Subject to any disclaimer, the term of this patent is extended or adjusted under 35 U.S.C. 154(b) by 0 days.

(21) Appl. No.: 09/751,033

(22) Filed: Dec. 29, 2000

Related U.S. Application Data

(63) Continuation of application No. 09/449,815, filed on Nov. 26, 1999, now abandoned, which is a continuation of application No. 09/192,556, filed on Oct. 29, 1998, now abandoned, which is a continuation of application No. 08/819,026, filed on Mar. 17, 1997, now abandoned, which is a continuation of application No. 08/579,736, filed on Dec. 28, 1995, now abandoned, which is a continuation-in-part of application No. 08/114,678, filed on Aug. 31, 1993, now Pat. No. 5,533,643, which is a continuation-in-part of application No. 07/877,401, filed on May 1, 1992, now Pat. No. 5,251,775.

(51) Int. Cl.[7] ..... B65F 1/16

(52) U.S. Cl. ..... 220/813; 220/908; 220/826; 220/833; 220/832

(58) Field of Search ..... 220/908, 812, 220/813, 826, 831, 832, 833, 1.5

(56) References Cited

U.S. PATENT DOCUMENTS 2,292,092 A * 8/1942 Shankweiler
2,338,477 A * 1/1944 Wolters et al.
4,603,787 A * 8/1986 Essary ..... 220/1.5
4,609,117 A * 9/1986 Pamment ..... 220/252
4,674,645 A * 6/1987 Instone et al.
4,821,902 A * 4/1989 May ..... 220/331
4,934,562 A * 6/1990 Early et al. ..... 220/1.5
5,251,775 A * 10/1993 Kruzick et al. ..... 220/331
5,533,643 A * 7/1996 Kruzick ..... 220/331
5,755,351 A * 5/1998 Kruzick ..... 220/331

* cited by examiner

*Primary Examiner*—Stephen Castellano
(74) *Attorney, Agent, or Firm*—Woodard, Emhardt, Naughton, Moriarty & McNett

(57) ABSTRACT

A waste handling, intermodal container includes a container body having left and right sides, a rear, a top, an upwardly facing top opening in the top, and a rear opening in the rear; a lid sized to cover said top opening and having a closed and clamped position tightly covering and sealing the top opening and an open position including said lid being vertically positioned along one side of the container body; a lid control and support mechanism connected with the lid and the container to support the lid and to permit the lid to be slid and pivoted between the closed and clamped position and the open position; a rear door hingedly connected along one side of the container to close off the rear opening; and, a retractable hinge assembly operable to retract the door tightly against the rear of the container body to seal the rear opening and to extend the door rearwardly to enable the door to be pivotally opened at the hinge assembly to a position alongside one side of the container body.

14 Claims, 15 Drawing Sheets

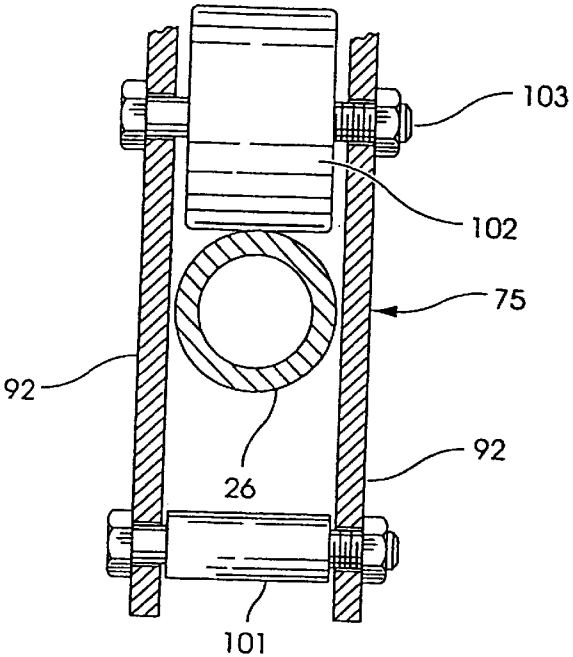
Fig.11
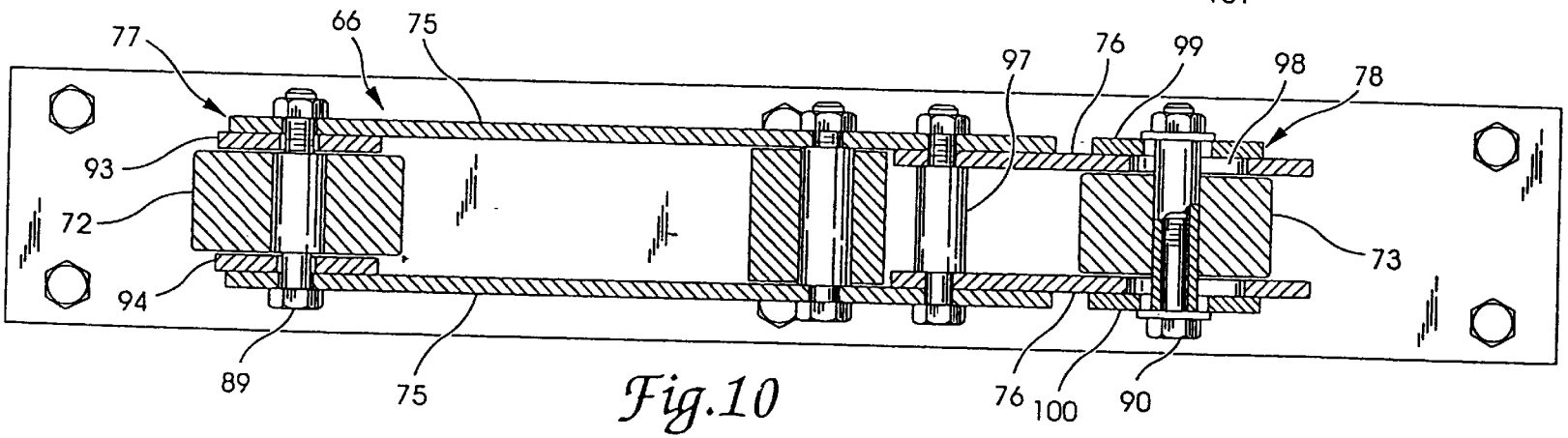
Fig.10
Fig. 9
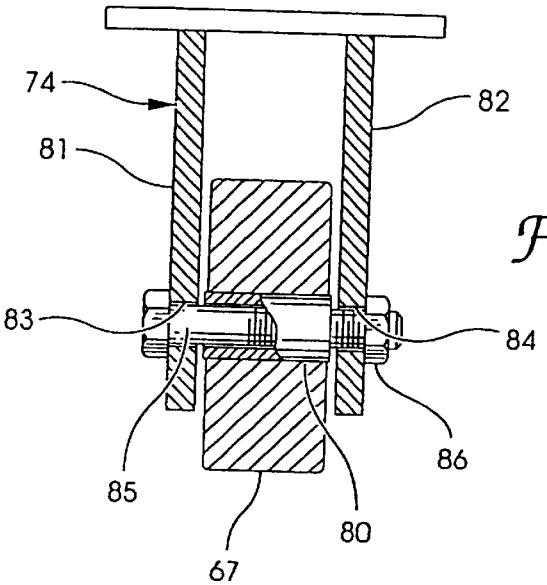

WASTE HANDLING INTERMODAL CONTAINER WITH SLIDING LID, SIDE-HINGED, END-MOUNTED DUMP DOOR AND SWING-AWAY HEADER

REFERENCE TO RELATED APPLICATIONS

This application is a Continuation of Ser. No. 09/449,815 filed Nov. 26, 1999, now abandoned, which is a Continuation of Ser. No. 09/192,556 filed Oct. 29, 1998, now abandoned, which is a Continuation of Ser. No. 08/819,026 filed Mar. 17, 1997, now abandoned, which is a Continuation of Ser. No. 08/579,736 filed Dec. 28, 1995, now abandoned, which is a Continuation-in-Part of Ser. No. 08/114,678 filed Aug. 31, 1993, now U.S. Pat. No. 5,533,643, which is a Continuation-in-Part of Ser. No. 07/877,401 filed May 1, 1992, now U.S. Pat. No. 5,251,775.

FIELD OF INVENTION

The present invention relates to the field of waste handling containers and specifically to an intermodal container having a very large lid and a combination sliding and pivoting mechanism to facilitate opening and closing the lid, and having a side-hinge-mounted door at one end of the container, the hinge and latching mechanism for the door being retractable to pull the door into a sealing relationship with the container whereby all components of the container are within the confines of corner blocks of the container, and having a header at the doored-end of the container that provides the guiding elements for the sliding and pivoting action of the lid and which operates to swing away from the opening along the inside of the container.

BACKGROUND OF THE INVENTION

Hazardous waste materials are frequently transported to disposal facilities in very large waste handling containers. A typical such container might measure 8'×18'×5' with an opening in the top thereof measuring 7'×14'. To safely close off this large opening, a one-piece lid must cover the entire opening and form a tight sea; against the container body to prevent the hazardous materials from escaping during transport.

One example of such a lid is shown is U.S. Pat. No. 4,934,562 wherein the lid has a downwardly extending, longitudinal flange which rides along rollers positioned on top of the container. A complicated screw-type mechanism is used to raise the lid from a sealed position, and then the lid is slid laterally along the rollers roughly half its width until a pair of spring-biased hooks catch corresponding hinge bars at the edge of the top of the container. The lid is thus hingedly connected to the top of the container and is pivoted to the side and out of the way of the opening. In addition to the significant risk of failure of the screw mechanism to unseal and raise the lid and the difficulty of servicing the screw mechanism, the lid can easily be de-railed from its tracks. Moreover, although fairly heavy, this lid has proven to be highly susceptible to the forces of a good wind gust which has picked the lid up, off and away from the container. It has also been found that the special spring-biased hooks do not reliably engage with the hinge members. This can and has left the lid skewed, de-railed, and jammed. Another example of this general type of sliding lid configuration is shown in U.S. Pat. No. 4,821,902. Here, the lid of a large waste container is supported for gliding horizontal movement atop rollers mounted to the top of the container.

These large waste containers are often transported by rail where maximum container height limits are set by the applicable federal regulation. To maximize the container volume, while staying within the container height limitations, it is desired that the mechanism for supporting the container lid for sliding and pivoting movement project above the container as little as possible.

Oftentimes, the above described containers are desired to be intermodal. That is, it is desired that they be capable of being transported by a number of different vehicles, such as, for example, a truck, a train or a ship. In multiple container transport such as on a ship, it is desired to stack the containers side by side, end to end, or on top of each other while still maximizing the amount of internal container space. A typical intermodal container has a set of corner blocks at each of the eight corners of the container, the corner blocks of one container abutting the corner blocks of the adjacent stacked container. All container components, including container walls, doors and lids, must not extend beyond the plane or boundaries defined by the eight corner blocks. It is, therefore, desired to provide an intermodal container with a side-hinged, end-opening door that maximizes the internal container room and yet satisfies intermodal container transport specifications.

It is further often desired to have containers as described above for transporting items that are easily manipulated by a forklift or similar vehicle. In such a case, where there is a side-hinged, end-opening door and a top-mounted, sliding lid, the clearance at the end opening at the top is simply too low to permit a forklift to drive into the container.

What is desired is a container that has a side-hinged, end-opening door, a large top-mounted, sliding lid, a configuration that permits for intermodal transport, and a configuration which permits driving of a forklift directly into the container.

SUMMARY OF THE INVENTION

Generally speaking, a large waste handling, intermodal container with a large opening in its top has a low profile lid which can be slid and pivoted to either side of the container by a single person with little difficulty, has a rear dump door hingedly mounted at the rear, along one side by a retractable hinge assembly that pulls the door tightly against the container to seal shut the rear opening, and has a swing away header to open up the rear opening for the ingress and egress of loading vehicles.

A waste handling, intermodal container includes a container body having left and right sides, a rear, a top, an upwardly facing top opening in the top, and a rear opening in the rear; a lid sized to cover said top opening and having a closed and clamped position tightly covering and sealing the top opening and an open position including said lid being vertically positioned along one side of the container body; a lid control and support mechanism connected with the lid and the container to support the lid and to permit the lid to be slid and pivoted between the closed and clamped position and the open position; a rear door hingedly connected along one side of the container to close off the rear opening; and, a retractable hinge assembly operable to retract the door tightly against the rear of the container body to seal the rear opening and to extend the door rearwardly to enable the door to be pivotally opened at the hinge assembly to a position alongside one side of the container body.

It is an object of the present invention to provide an improved waste handling container.

It is another object of the present invention to provide a waste handling, intermodal container with a side-hinged, end mounted dump door.

It is yet another object of the present invention to provide a waste handling, intermodal container with a side-hinged, end mounted dump door where the container is openable at its rear to enable ingress and egress of loading vehicles.

Further objects and advantages of the present invention will become apparent from the following description of the preferred embodiment.

BRIEF DESCRIPTION OF THE DRAWINGS

FIG. 9 is a cross-sectional view of one of the end rollers 67 and roller brackets 74.

FIG. 10 is a bottom cross-sectional view of roller assembly 66 taken along the lines 10—10 of FIG. 4 and viewed in the direction of the arrows.

FIG. 11 is a cross-sectional view of a portion of roller assembly 66 taken along the lines 11—11 of FIG. 4 and viewed in the direction of the arrows.

DESCRIPTION OF THE PREFERRED EMBODIMENT

Figure 1:
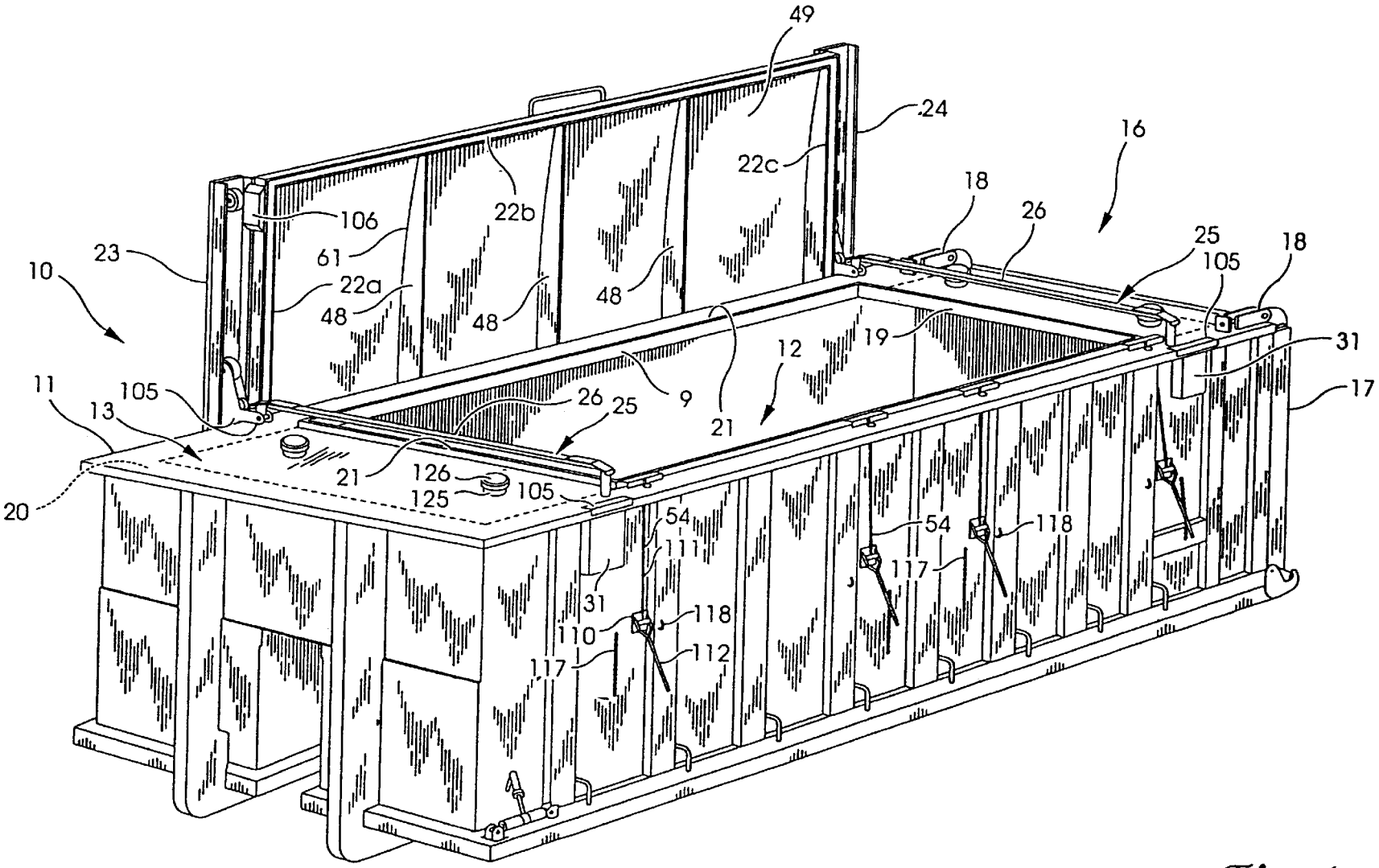
FIG. 1 is a perspective view of a waste handling container 10 with a sliding and pivoting lid 15 in accordance with the preferred embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, and alterations and modifications in the illustrated device, and further applications of the principles of the invention as illustrated therein are herein contemplated as would normally occur to one skilled in the art to which the invention relates.

Figure 2:
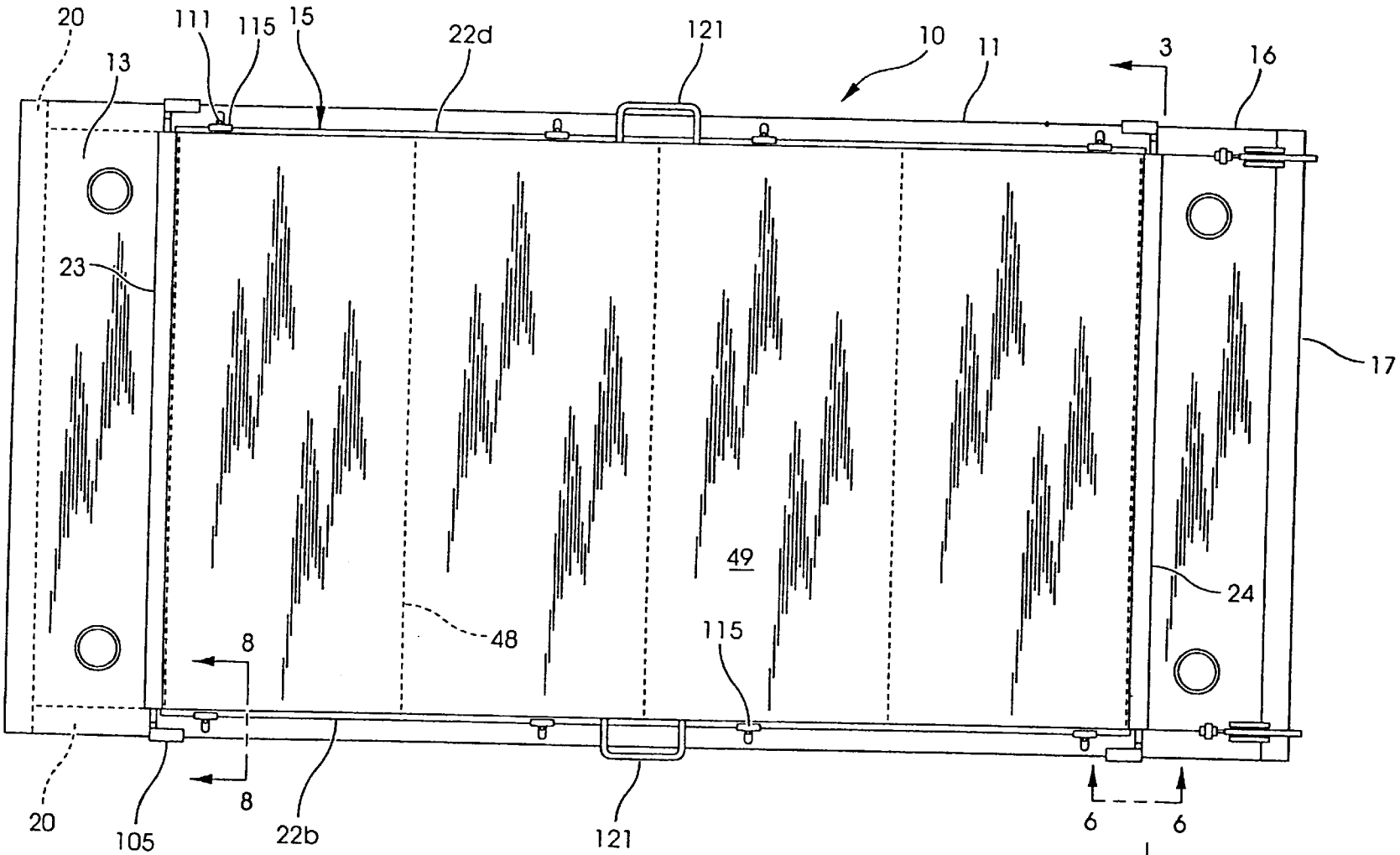
FIG. 2 is a plan view of the waste handling container 10 of FIG. 1 with the lid 15 in the closed and locked position.

Referring to FIGS. 1 and 2 there is shown a waste handling container 10 in accordance with the preferred embodiment of the present invention. Container 10 generally includes a container body 11 with a large rectangular-shaped opening 12 defined in its top 13; a sliding lid 15 to removably close off and seal opening 12; and, a door 17 hingedly mounted at hinges 18 to top 13 to sealably close off the one open end 16 of container body 11. Container 10 is adapted to sit on the ground with lid 12 pivoted to either side of container body 11 as shown in FIG. 1 and to receive waste materials through opening 12. When desired, lid 15 may easily be pivoted to a horizontal position and slid closed and locked down by one person, as described herein. Container 10 may then be safely transported to a disposal site where door 17 may be released and pivoted about hinges 18 to release the container contents.

Figure 3:
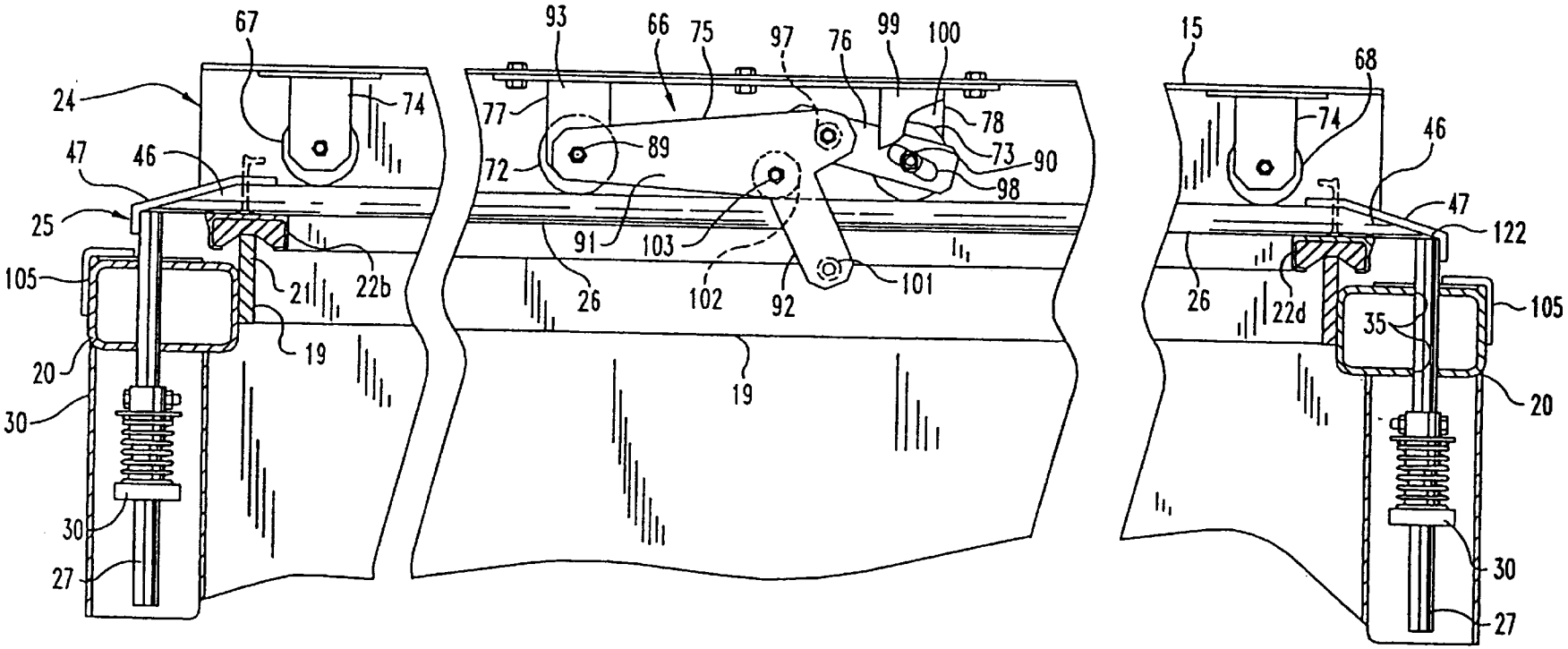
FIG. 3 is a fragmented cross-sectional view of the container 10 of FIG. 2 taken along the lines 3—3 and viewed in the direction of the arrows, with a portion of the container body 11 broken away to expose the sealing flange 21 and the channels 22*b* and 22*d* in cross-section, and with the lid 15 in the closed and clamped position.

Referring now to FIGS. 1–3, container body 11 generally includes a welded skeleton of rectangular cross-sectioned tubing with steel panels welded thereto. Included in the container skeleton are upper rectangular cross-sectioned tubing members 20 which extend around the periphery of and generally frame the top 13 of body 11. Four flat, bar stock members 19 are fixed together and to tubing members 20 to define rectangular opening 12 and to collectively form an upstanding rectangular sealing flange 21. Sealing flange 21 extends above tubing members 20 to permit full engagement with sealing channel 22 of lid 15, that is, so that sealing channel 22 does not contact the top of tubing members 20 when lid 15 and its sealing channels 22 are pulled downwardly into the sealed position.

Figure 6:
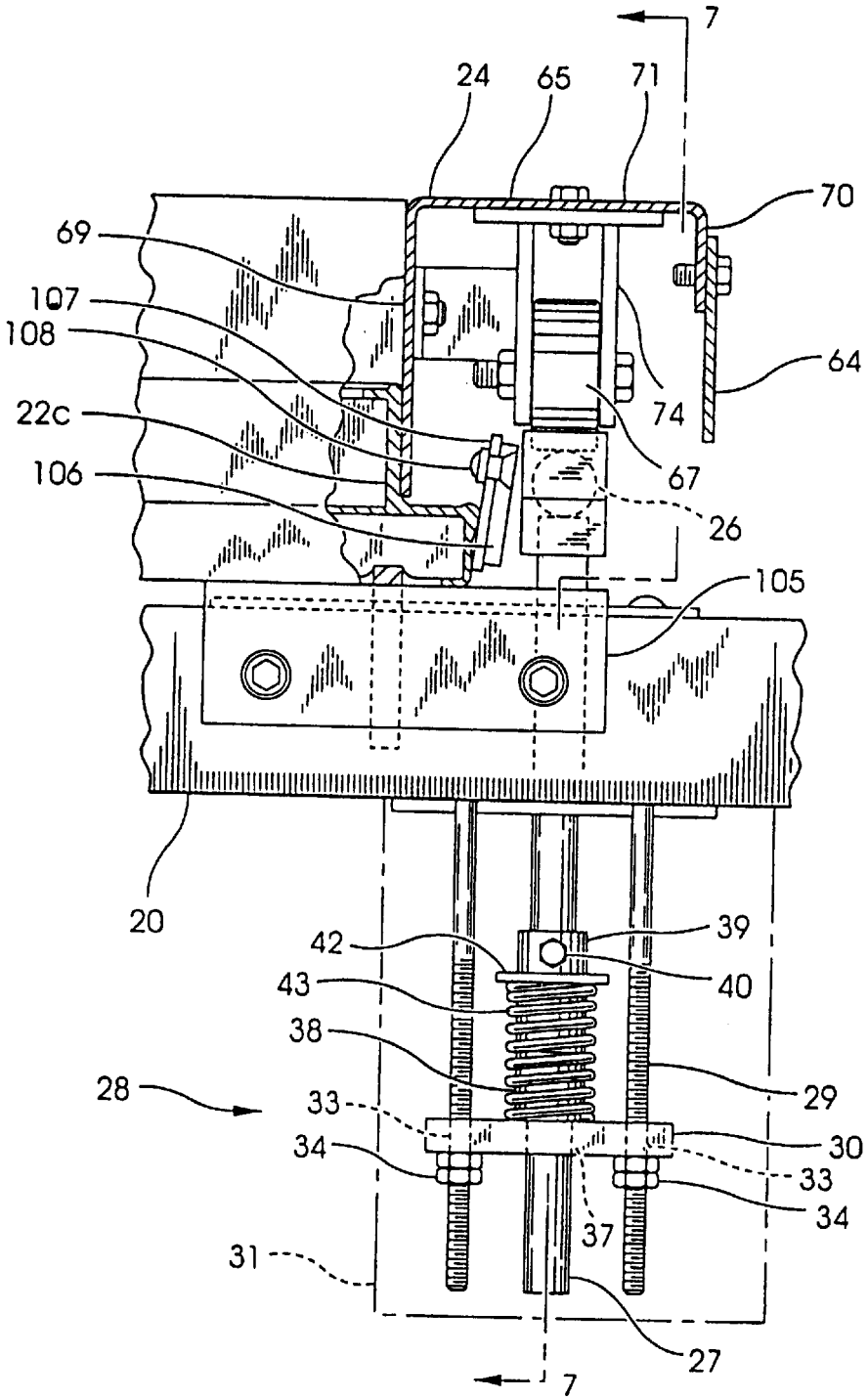
FIG. 6 is a cross-sectional view of the container 10 taken along the lines 6—6 of FIG. 2 and viewed in the direction of the arrows, with portions broken away for clarity.

Container 10 also includes a lid support assembly for holding, guiding, pivoting and generally enabling the nearly effortless opening and closing of lid 15. This lid support assembly includes a pair of guide rail assemblies 25 mounted to container body 11 at opposite sides of opening 12, and includes a corresponding pair of combination roller units 23 and 24 mounted at opposite ends of lid 15. The two guide rail assemblies 25 are identical and the following description will apply equally to both. Referring to FIGS. 1, 3, 6 and 7, assembly 25 includes a longitudinal tubular guide rail 26 supported at its opposite ends by and fixedly connected to posts 27. Posts 27 are mounted for vertical reciprocal movement relative to container body 11 by guide rail suspension units 28. Units 28 are mounted to and exteriorly of container body 11, but are enclosed by hingedly mounted cover boxes 31. Each suspension unit 28 includes a pair of spaced apart carriage bolts 29 which extend downwardly through holes in framing 20. A generally flat, rectangular spring base 30 has a pair of holes 33 spaced to enable base 30 to receive a corresponding pair of the bolts 29 therethrough as shown in FIG. 6. A pair of nuts 34 on each carriage bolt 29 supports base 30 and defines the position of base 30 relative to bolts 29 and to framing 20. Adjustment of nuts 34 thereby permits the position of base 30 to be vertically varied relative to framing 20. Each post 27 extends downwardly from its connection to guide rail 26, through holes 35 and 36 in framing 20, and through aligned hole 37 in base 30. A lower cylindrical collar 38 is rigidly secured atop spring base 30 and is coaxially aligned with hole 37 to surround post 27. An upper collar 39 is also cylindrical, surrounds post 27 above lower collar 38 and is adjustably fixed to post 27 as by a set screw 40. Upper collar 39 is sized larger than hole 36 of framing 20. The upper limit of travel of collar 39, and thus post 27 and rail 26 attached thereto, is thereby adjustably determined. Upper collar 39 also includes an outwardly extending annular flange 42 about midway along its height. A coil spring 43 encircles both collars 38 and 39 and extends vertically between flange 41 and spring base 30. Guide rail 26 and its posts 27 are thereby biased upwardly by the springs 43, but may be forced downwardly until upper collar 39 contacts lower collar 38 which is, of course, precluded from moving downward by base 30 and nuts 34. This downward limit is generally not reached in operation, however, because the downward movement of lid 15 will be limited by the engagement of sealing channel 22 with sealing flange 21 before collars 38 and 39 ever touch. Vertical adjustment of base 30 then serves to vary the spring force of spring 43 acting to bias guide rail upwardly. The sizing of collars 38 and 39, the positionment of upper collar 39 and the properties of spring 43 may all be selected as desired to upwardly support lid 15 at all stages of positionment thereof and to provide the desired resistance to closing and locking of lid 15 by locking clamps 54.

Figure 7:
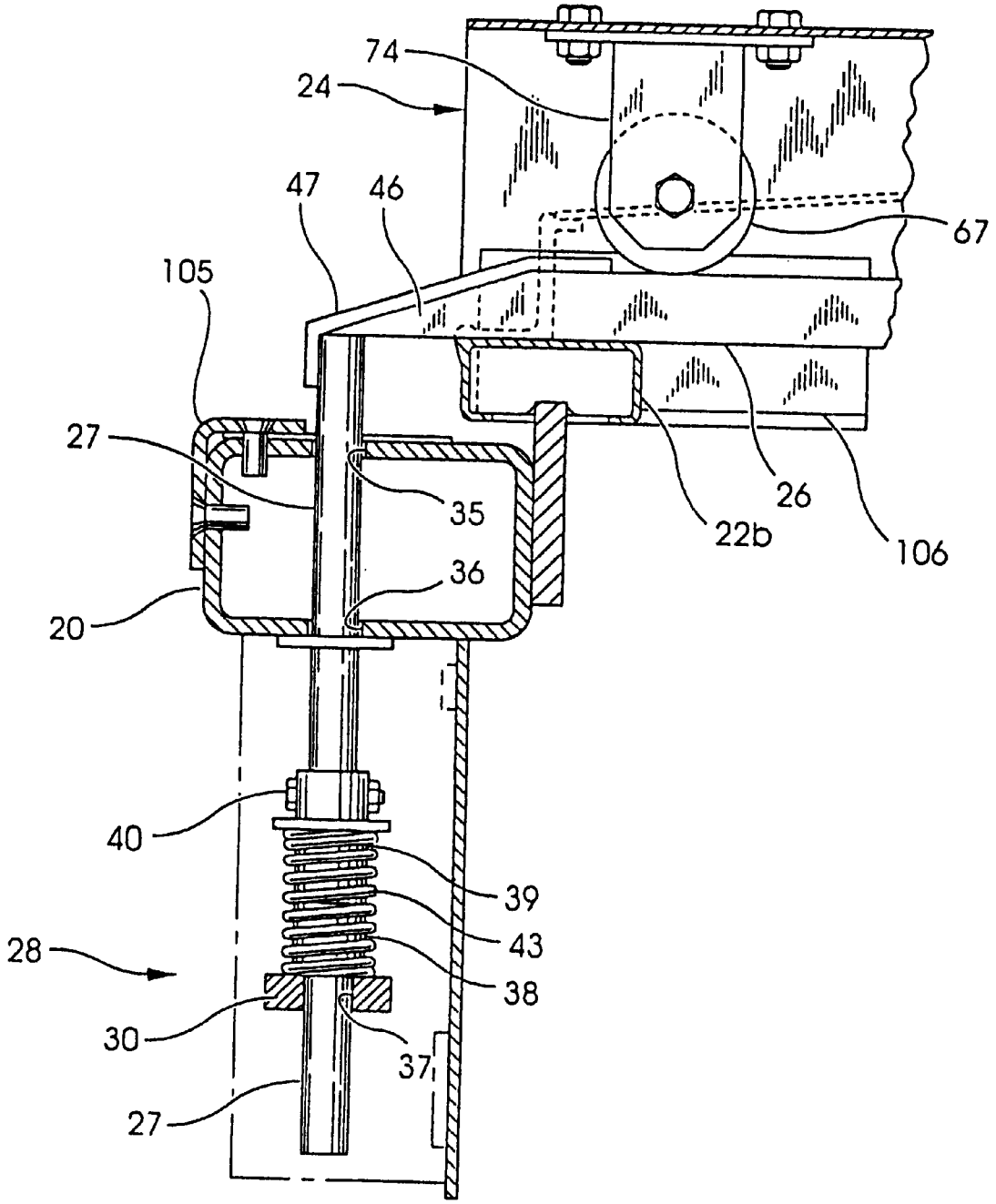
FIG. 7 is a cross-sectional view of the container 10 taken along the lines 7—7 of FIG. 6 and viewed in the direction of the arrows.

Guide rail 26 is a circular cross-sectioned pipe having beveled ends 46 which connect to their corresponding posts 27. Posts 27 both support guide rail 26 and form stops which engage with roller assemblies 66 as described herein. End caps 47 are fixedly secured to corresponding ends 46 of rail 26 and to the connecting posts 27. In one embodiment, as shown in FIG. 7, caps 47 follow the slope of the bevel of ends 46 at an angle of about 22°, and caps 47 have a thickness of one quarter inch, thereby providing a centering function for lid 15 as described herein.

Figure 8:
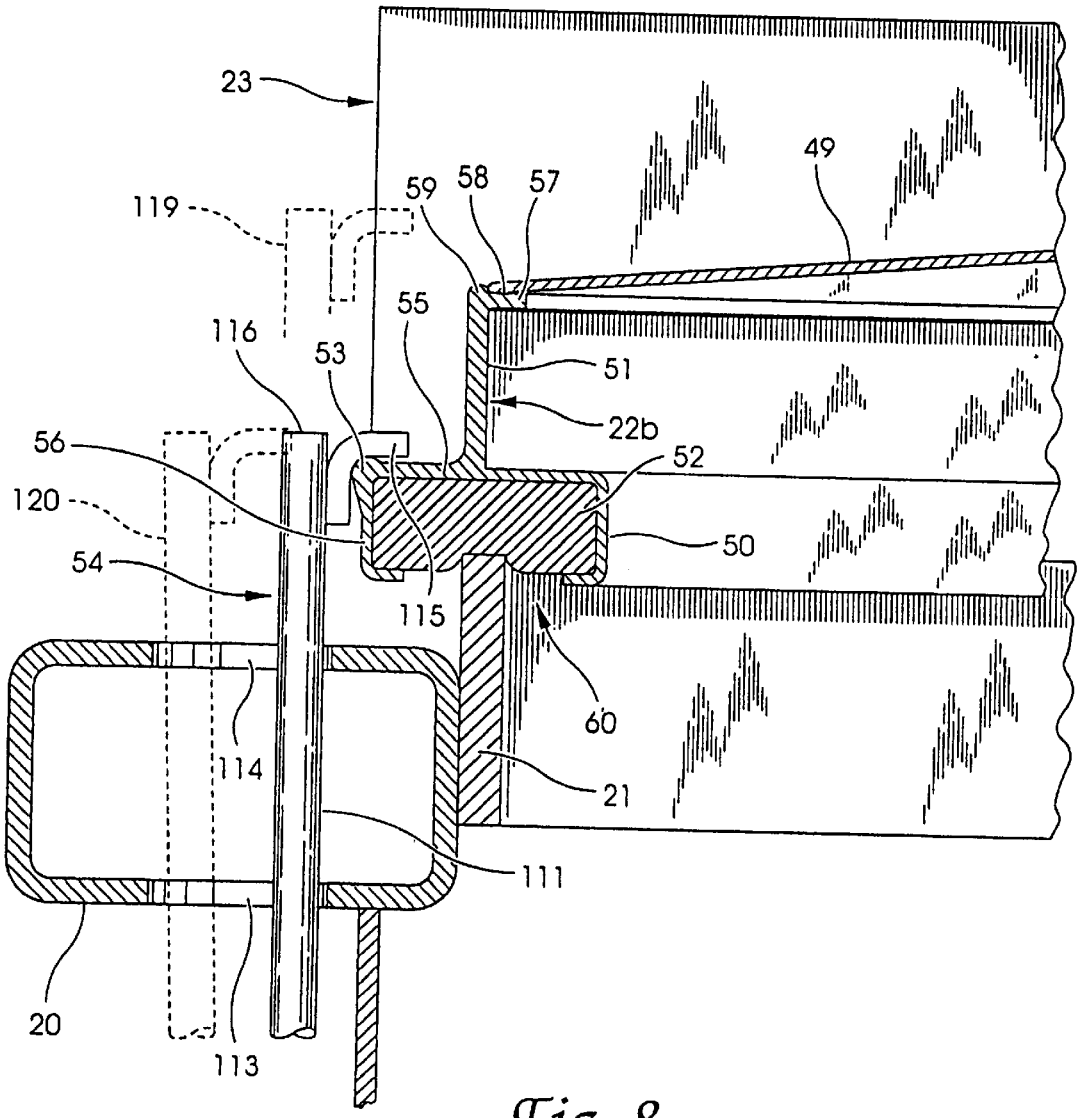
FIG. 8 is a cross-sectional view of a portion of the container taken along the lines 8—8 of FIG. 2 and viewed in the direction of the arrows.

Referring now to FIGS. 1, 2 and 8, lid 15 is generally composed of extruded sealing channels 22*a*–22*d*, arcuate lid panel supports 48, lid cover panel 49 and combination roller units 23 and 24. There are four longitudinal sections of extruded channels 22*a*–22*d* which are fixed together as by welding to form the rectangular frame of lid 15. Each channel 22*a*–22*d* generally includes a C-section channel portion 50 and a rib portion 51 extending upwardly therefrom (FIG. 8). The C-sectionX channel portion 50 holds therein a resilient sealing gasket material 52 made of a rubber-type material appropriate for forming a tight sealing relative to the waste materials to be hauled. Selection of such an appropriate material is believed to be well known in the industry. Channel portion 50 defines a longitudinal opening 60 (approximately 1.75 inches wide in one embodiment) through which sealing flange 21 can extend and engage the gasket material 52 to tightly and safely seal lid 51 over opening 12.

At the upper and outer corner of channel portion 50, the thickness is increased to form a longitudinal bulbous edge 53 which runs at least at portions of, and preferably the entire length of, channel 22 to engage with a series of lid locking clamps 54. To enhance the strength of channel 22 during the lid hold-down and locking stages, the thickness of the entire upper segment 55, to the outside of rib portion 51, has been thickened. In one embodiment, where, over the greatest length of roughly 14 feet (channels 22*b* and 22*d*), the thickness of channel portion 50 to the inside of rib portion 51 is about 0.125 inches, and the inside dimensions of channel portion 50 measure approximately one inch high by two and one half inches wide, segment 55 has a thickness 50 percent greater than the remainder of channel portion 50 and a bulbous edge 53 which protrudes upwardly of segment 55 by approximately 0.066 inches and outwardly of outer side segment 56 by approximately 0.128 inches. This design is believed to enhance the torsional strength of channels 22*a*–22*d*, and thus lid 15, as well as the reliability of lid locking clamps 54. Near the top of rib portion 51, a longitudinal, lid panel support flange 57 extends inwardly and slightly upwardly therefrom, at an angle of approximately 94° from the rib portion therebelow. In one embodiment, flange support 57 extended outwardly from rib portion 51 to leave a gap of approximately 0.0974 inches between flange support 57 and the top 59 of rib portion 51, thereby leaving a longitudinal ledge 58 in each channel 22*a*–22*d*. Lid cover 49 is seated within the ledges 58 of the longer opposing channels 22*b* and 22*d* and fixed thereto as by welding. (FIG. 8). At the shorter opposing ends of lid 15, lid cover 49 is fixed as by welding to the inner, vertical sides of the two corresponding combination roller units 23 and 24. Between the ends of lid 15 and roller units 23 and 24, there are three spaced-apart, lid panel supports 48 which span the width of lid 15 (FIG. 1). Supports 48 are arcuate at their upper sides 61. Lid panel 49 rests atop and are welded to arcuate supports 48 with the edges of lid panel 49 fixed to opposing channels 22*b* and 22*d* and to combination roller units 23 and 24, as described above.

Figure 4:
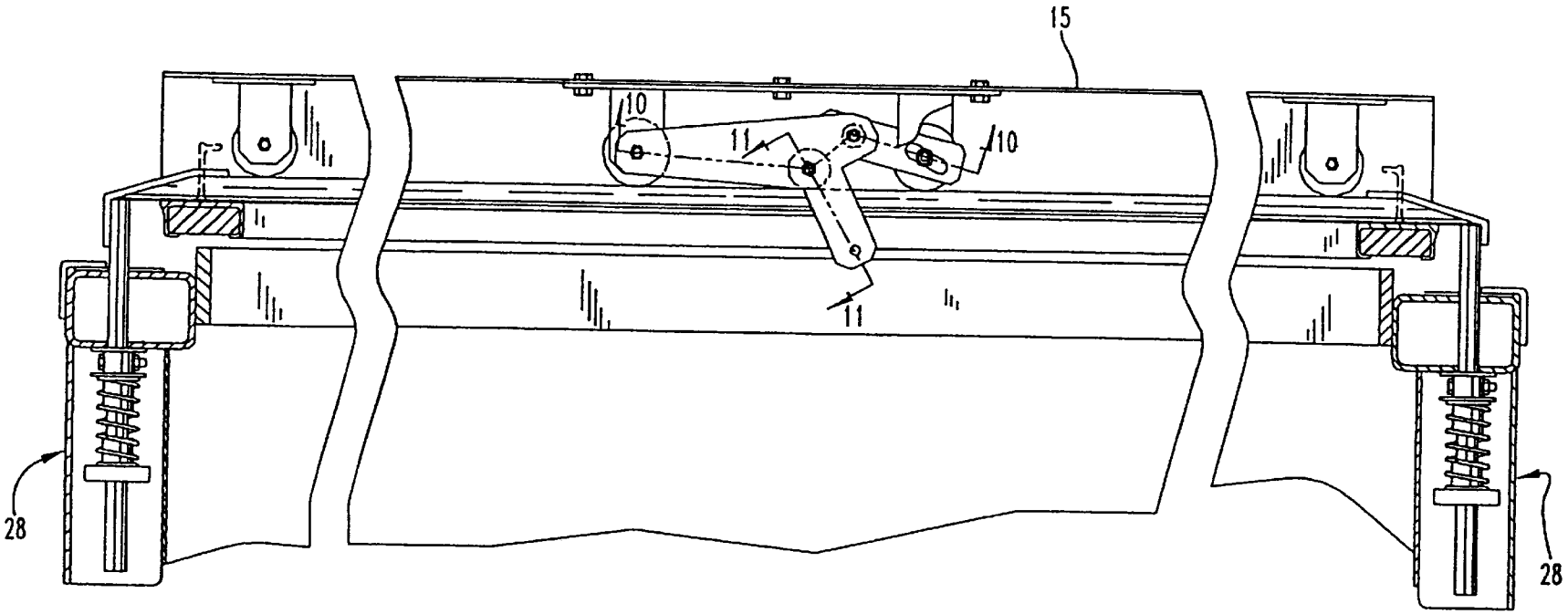
FIG. 4 is a fragmented cross-sectional view of the container 10 shown in FIG. 3, here showing lid 15 in the closed and unclamped position biased upwardly by the suspension units 28.
Figure 5:
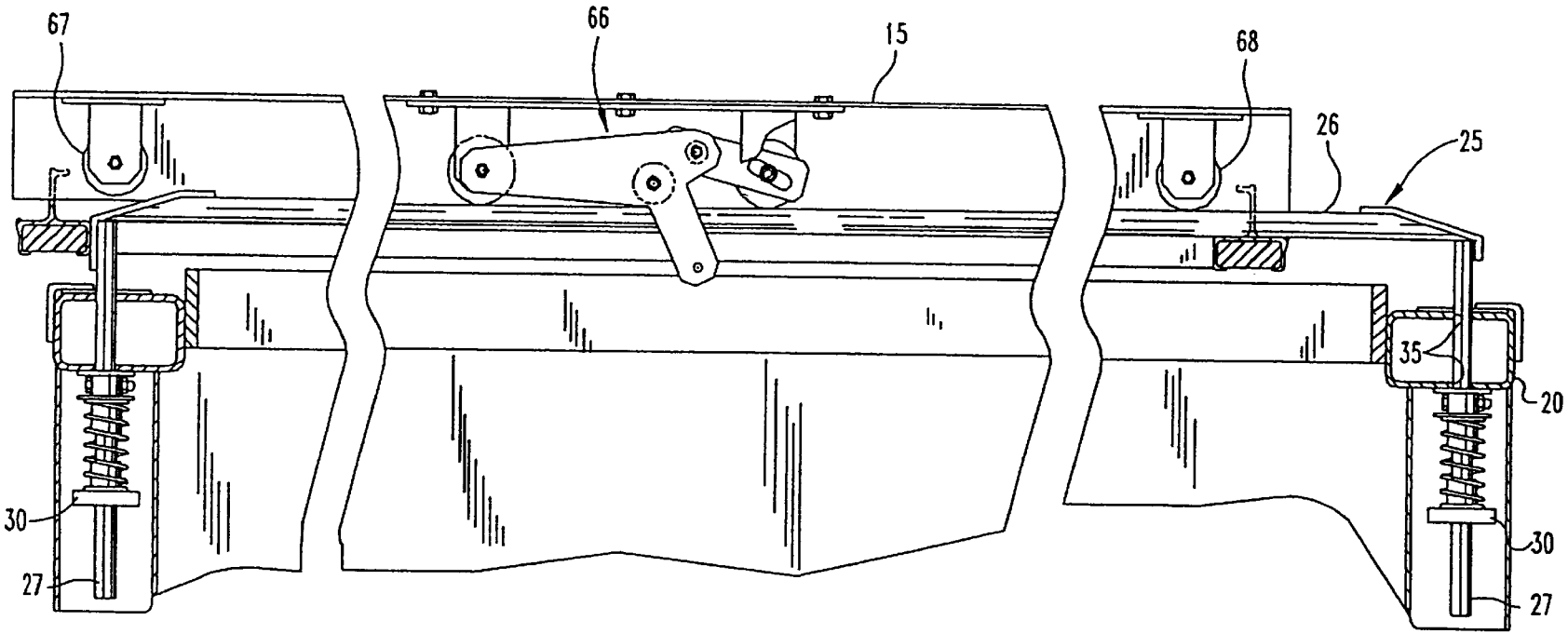
FIG. 5 is a fragmented cross-sectional view of the container of FIG. 4, here showing lid 15 positioned laterally along guide rail 26 from the closed and unclamped position.

The two combination roller units 23 and 24 are themselves fixedly secured at opposite ends of lid 15 to channels 22*a* and 22*c*, respectively (FIG. 6). Units 23 and 24 are identical except where indicated and only one will be described herein. As shown in FIGS. 1 and 3–7, unit 24 includes a partially enclosing housing 65, a centrally located roller assembly 66 and a pair of end rollers 67 and 68. Housing 65 is a downwardly opening channel made of longitudinal sheet with a pair of right angle bends. The resulting housing includes a long inner side 69, a short outer side 70, and a top base 71 therebetween (FIG. 6). A flat longitudinal access plate 64 is bolted to short side 70 to partially cover roller assembly 66 and rollers 67 and 68, but is removable to permit access thereto for servicing. Housing 65 of roller unit 24 is fixedly secured in planar abutment to rib portion 51 of its corresponding sealing channel 22*c* at one end of lid 15 by appropriate means such as welding. Each end roller 67 and 68 is held for rotation by a roller bracket 74 which is fixed to both base 71 and inner side 69, as shown. Roller assembly 66 helps to support lid 15 upon guide rail 26 and operates in conjunction with guide rail 26 to permit lid 15 to hingedly pivot to either side of container body 11 as follows. Referring to FIGS. 3–5, roller assembly 66 includes a pair of support rollers 72 and 73 which are mounted to top base 71 by brackets 77 and 78, respectively and includes a pivot link 75 and a connecting link 76. Brackets 77 and 78 hold their corresponding rollers 72 and 73 for rotation about axles 89 and 90 in a manner similar to the way brackets 74 hold their end rollers 67 and 68. That is, referring to roller 67 as shown in FIG. 9, a pipe member 80 extends through a central passageway in roller 67 and between the pair of downwardly extending bracket arms 81 and 82 of the bracket 74. A bolt 85 extends through aligned holes 83 and 84 in bracket arms 81 and 82, respectively, and through pipe member 80 and roller 67 to form an axle therewith. A nut 86 secures bolt 85 in place. The combination of all of rollers 67 and 68 and the rollers 72 and 73 of roller assembly allow lid 15 to effectively "slide" atop container body 11.

Pivot link 75 is actually two identically shaped pivot links 75 (FIGS. 3 and 10), each including a central body portion 91 and a retaining arm 92. The two pivot links 75 are each pivotally mounted at one of their ends to the axle 89 of roller 72, outside of the opposing, downwardly extending bracket arms 93 and 94 of bracket 77. Likewise, connecting link 76 is actually two identically shaped connecting links 76 which are pivotally connected at one of their ends by hinge pin 97 to corresponding links 75 and are pivotally and slidably connected at their opposite ends to axle 90 of roller 73. The combination pivoting and sliding movement of links 76 relative to axle 90 is achieved by a slot 98 defined in each link 76 and through which axle 90 extends with the two links 76 juxtaposed outside of roller 73 and inside of the corresponding, downwardly extending bracket arms 99 and 100 of bracket 78. Bracket arms 99 and 100 are generally coplanar with pivot links 75, and bracket arms 93 and 94 are generally coplanar with connecting links 76. The two retaining arms 92 of pivot links 75 extend downwardly therefrom at an angle and on opposite sides of guide rail 26 (FIGS. 3 and 11). A pin 101 extends between and is fixed to the two arms 92 below guide rail 26. An auxiliary support roller 102 is rotatably supported between pivot links 75 by an axle 103 at roughly the intersection between central body portion 91 and retaining arm 92. With this configuration, roller assembly 66 is essentially locked to guide rail 26 at all times. Thus, lid 15 and its rollers 67, 68, 72 and 73 may be lifted only a short distance away from guide rail 26 before pin 101 engages the bottom of guide rail 26. Links 75 and 76 of roller assembly 66 may then pivot somewhat (about axles 89 and 90 and pin 97) to permit an additional degree of movement of lid 15 upwardly from guide rail 26; however, a limit is ultimately reached where lid 15 can be lifted no more. As defined herein, the present configuration of roller assembly 66 and guide rail 26 also defines the limits of lateral movement of lid 15. As a result, lid 15 is held fairly securely to move only along rails 26 as described below. While the weight of lid 15 alone would be adequate to keep lid 15 resting atop guide rail 26, a heavy wind gust could easily lift lid 15 up and off of container body 11. The present configuration of guide rail 26 and roller assembly 66 with pin 101 prevents this from happening.

A set of four, L-shaped, nylon, wear strips 105 (FIGS. 1, 3, 6 an 7) are secured on both sides of container body 11 to tubular framing 20 at positions appropriate to engage with each of the two roller assemblies 66 during the pivoting action of lid 15 as described below. Two nylon bearing pads 106 (FIGS. 1, 6 and 7) are fixed to the outer sides of the channel portions 50 of each of the end sealing channels 22*a* and 22*c* of lid 15. Each bearing pad 106 is secured to a mounting plate 107 by recessed screws 108, and each mounting plate 107 is secured as by welding to its corresponding channel 22*a* or 22*c*. The two pads 106 of each channel 22*a* and 22*c* are spaced mutually apart so that there is a paid at each corner of lid 5, as seen in FIG. 7. In addition to this positionment, pads 106 are sized relative to the corresponding components to engage the corresponding guide rails 26 when necessary to assure that lid 15 remains on track on guide rails 26.

Referring to FIGS. 1 and 8, there are four, identical locking clamps 54 on each side of container body 11. Each clamp 54 includes a fulcrum lever arrangement 110 (FIG. 1), as is well known in the art, which allows a rod 111 to be drawn a short distance downward with great force through movement of a hand lever 112 with application of little force. Lever arrangement 110 is preferably of the type permitting adjustment of the position and/or stroke of rod 111. Rod 111 extends from lever arrangement 110 up through slots 113 and 114 defined in tubular framing 20. A hook member 115 is secured as by welding at the top 116 of rod 111 and above tubular framing 20. Hook 115 of each clamp 54 is thereby adapted to engage and lock with a corresponding section of bulbous edge 53 of channels 22*b* and 22*d*. A chain and hook combination is provided to secure each locking clamp 54 in the locked position to ensure that locking clamps 54, and thereby lid 15, stay locked down during transport.

In operation, lid 15 is opened and sealably closed as follows:

FIG. 3 shows lid 15 in the closed and clamped position where the eight clamps 54 are lockingly engaged with the corresponding sealing-channels 22*b* and 22*d*, and sealing channels 22*a*–22*d* and their gaskets 52 are sealingly engaged with the upstanding sealing flange 21. To unlock lid 15, each chain 117 is released from its hook 118 and hand lever 112 is pivoted upwardly which moves rod 111 and its hook 115 to an upwardly disengaged position indicated at 119 in FIG. 8. In this position, hook 115 is high enough to be totally disengaged from and spaced above the corresponding channel 22*b* or 22*d* and rods 111 and their hooks 115 then may be pivoted outwardly within slots 113 and 114 and completely clear of lid 15 while hand levers 112 are pivoted back down, which pulls the corresponding rod 111 to a downward and outward disengaged position at 120. As each clamp 54 is disengaged from lid 15, suspension units 28 bias guide rails 26, and lid 15 riding thereupon, upwardly to the limit defined by upper collars 39, which are secured to posts 27. With all of rod 111 and hooks 115 outwardly clear of lid 15, suspension units 28 have raised lid 15 to a closed and unclamped position (FIG. 4) upwardly clear of sealing flange 21 and above the top 116 of each rod 111. One of two handles 121 on either side of lid 15 may then be grasped and pulled, which moves lid 15 laterally to that side along guide rails 26 (FIG. 5).

Figure 12:
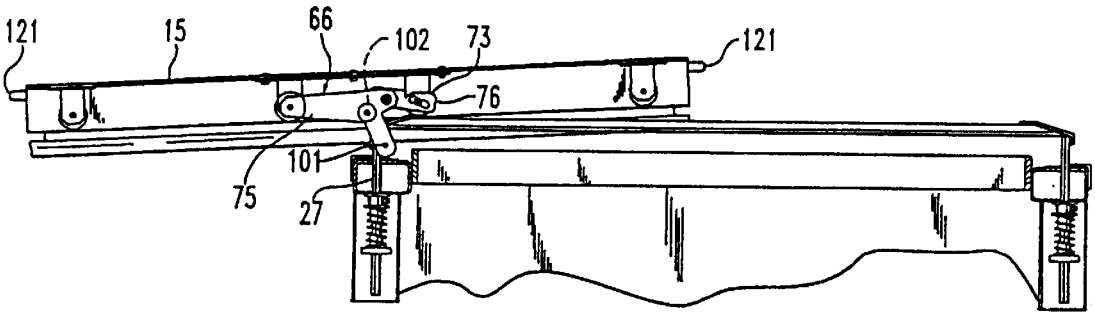
FIGS. 12–14 are side, cross-sectional views similar to those of FIGS. 3–5 showing the pivoting motion of lid 15 to its vertical resting position alongside container body 11.
Figure 13:
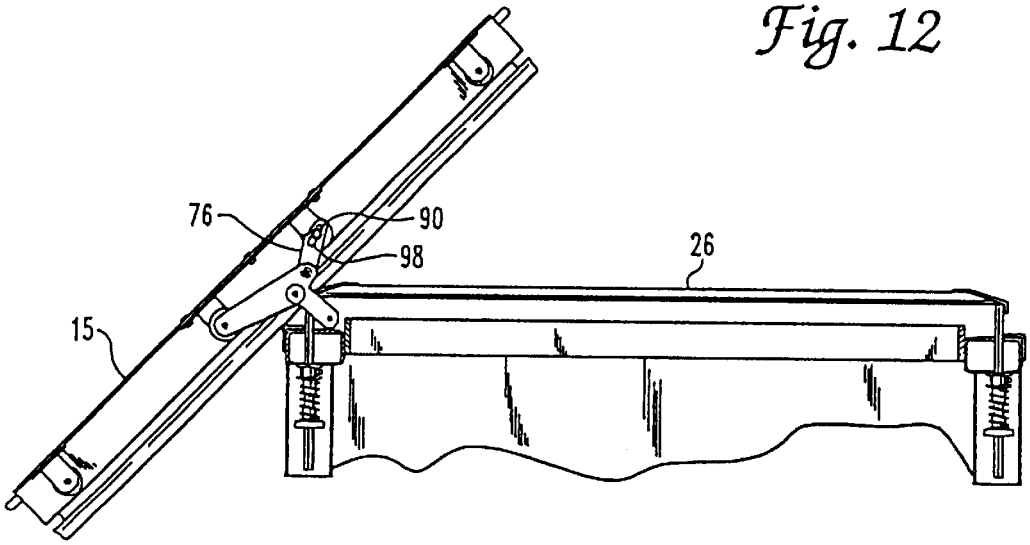
Figure 14:
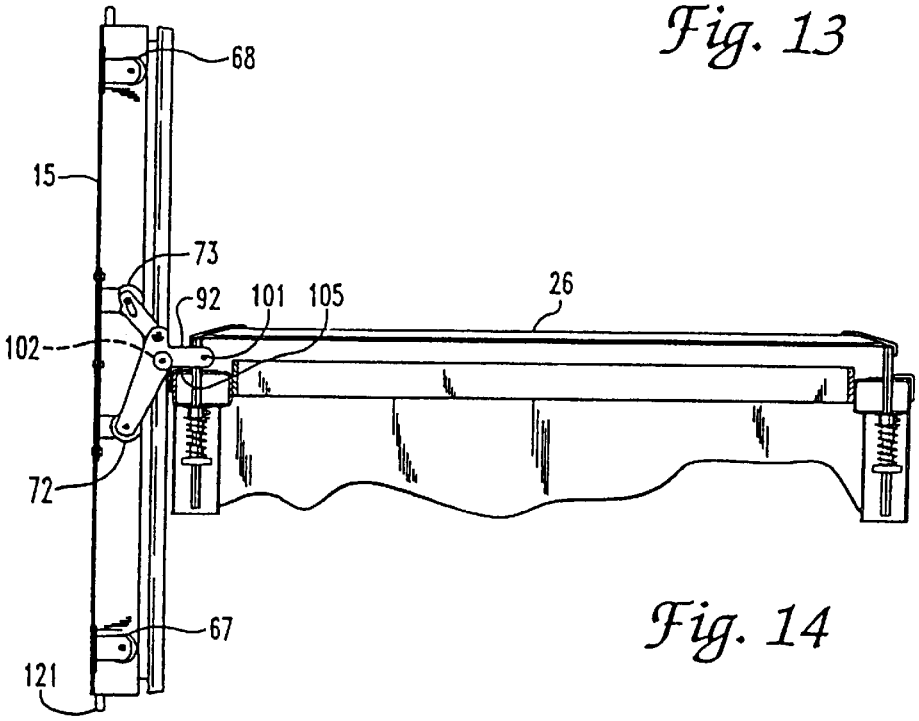

When lid 15 has moved roughly half its distance to one side, the two pins 101 on each roller assembly 66 will contact the corresponding posts 27, as shown in FIG. 12, at which point lid 15 stops moving laterally and is then pivoted roughly about the innermost roller of roller assembly 66 (here, roller 73) and auxiliary support roller 102. The action of pivot link 75 and connecting link 76 provide sufficient play to ensure clearance for the pivoting lid 15 as it pivots over the edge of the container body. The configuration, sizing and placing of roller assembly 66 and its rollers 72 and 73 is such that lid 15 is fairly well balanced as it pivots at this one end of container body 11 so that the operator grasping handle 121 can fairly easily lower the end of lid 15 that he or she is holding as it pivots (FIG. 13) through roughly a 90° angle to the open and resting position shown in FIG. 14. As seen from FIGS. 12–14, the connecting link 76 moves somewhat laterally by virtue of its slot 98 and axle 90 to the extreme shown in FIG. 14, at which point lid 15 is generally supported by the retaining arm 92 of pivot link 75 resting on nylon wear strips 105. In one embodiment, the relative dimensions of the components, specifically of roller assembly 66, are as shown in FIGS. 3–5 and 12–14, this particular configuration providing a smooth sliding and pivoting operation of lid 15.

To close and seal lid 15, the reverse procedure is generally performed. That is, handle 121 is grasped and lifted to pivot lid 15 generally about pin 101. When lid 15 has substantially reached a horizontal position, the operator pushes lid 15 to slide it completely atop container 11. The ramped configuration of end caps 47 facilitate the engagement of rollers 73, 102, 72 and 67 as they contact guide rail 26. As referred to above, end caps 47 have a thickness such that, as the operator pushes lid 15 toward a closed position, the leading end roller (here, roller 68) reaches the corresponding far end cap 47 (here, designated as 122 in FIG. 3), and engages it. When roller 68 hits end cap 122, the operator can "feel" the contact and then knows that the lid has reached a position between the two end caps 47 as shown in FIG. 3. With lid 15 thus centered, the operator engages each clamp 54 by lifting the corresponding hand lever 112, positioning rod 111 and its hook 115 over and against corresponding bulbous edge 53, and then lowers handle 112 all the way down to pull lid 15 and its sealing channels **22*a*–22*d* tightly against sealing flange 21. Chains 117 are then firmly positioned around their corresponding handles 112 and are attached to their hook 118, which thus prevents handles 112** from flipping up during transport.

Container body 11 is also provided with a number of air vents 125 with screw caps 126 which can be partially or completely removed to enable the release of pressurized gases which may build up while lid 15 is closed.

The opening, closing and clamping operation of door 17 at the end 16 of container 11, as well as the loading, transport and unloading of container 10 are believed to be well known in this art and are not described herein.

Figure 15:
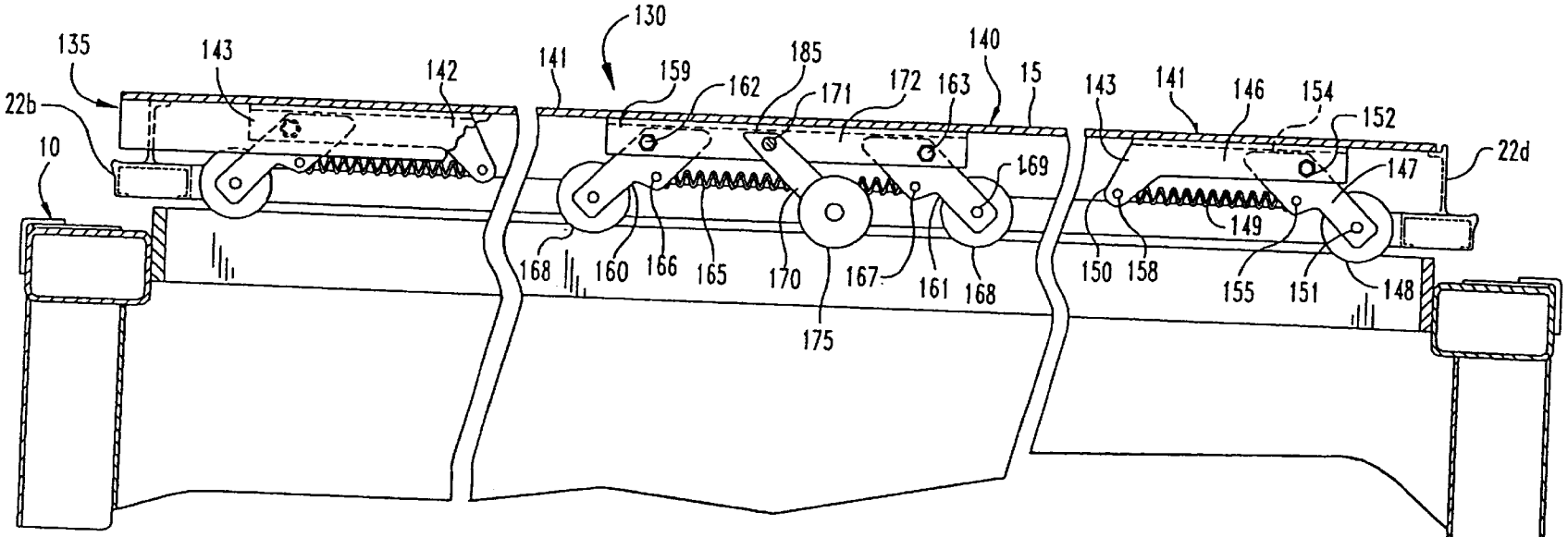
FIG. 15 is a fragmented cross-sectional view of an alternative embodiment of the container 10 of FIG. 2 taken along the lines 3—3 and viewed in the direction of the arrows, with a portion of the container body broken away to expose the sealing flange 21 and the channels 22*b* and 22*d* in cross-section, and with lid 15 in the closed and unclamped position biased upwardly by the spring loaded roller assemblies.
Figure 16:
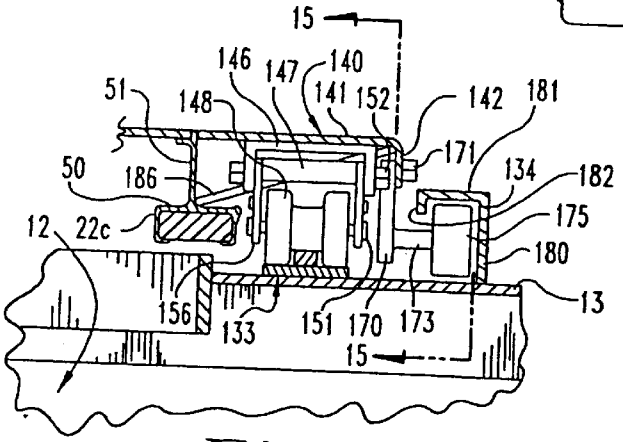
FIG. 16 is a cross-sectional view of the an alternative embodiment of the container 10 of FIG. 2 taken along the lines 6—6 and viewed in the direction of the arrows, with portions broken away for clarity and corresponding to the container shown in FIG. 15.
Figure 17:
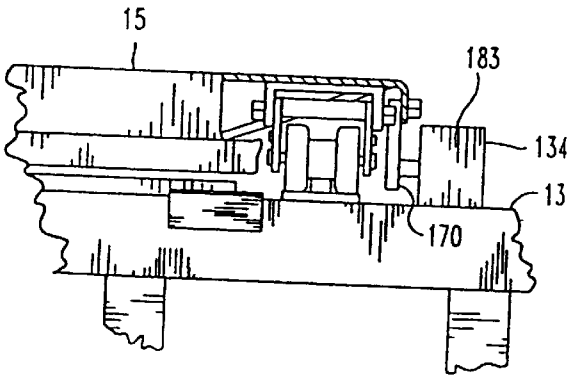
FIG. 17 is a side elevational view of the portion of the container shown in FIG. 16.

In another embodiment shown in FIGS. 15 through 17, there is shown a lid support assembly 130 for supporting a container lid 15 for sliding and pivoting movement relative to the container 10. In relation to the container 10 of FIGS. 1–14, lid support assembly 130 of FIGS. 15 and 16 includes a pair of guide rails 133 and a pair of guide channels 134 fixed to the top 13 of container 10, at opposite ends of opening 12, and in place of guide rail assemblies 25. Lid support assembly 130 further includes a pair of combination roller units 135 mounted to and at opposite ends of lid 15 in place of roller units 23 and 24. As with the guide rail assemblies 25 and combination roller unit 23 and 24 of FIGS. 1–14, the pairs of guide rails 133, guide channels 134 and roller units 135, at opposite sides of opening 12 and lid 15, are essentially mirror images of each other and description of only one member of any of the three pairs will be understood to apply to the corresponding other of the pair.

Combination roller units 135 extend outwardly from each end of lid 15, just outside of sealing channels **22*a* and 22*c*. Sealing channels 22*a*–22*d* have roughly the same configuration as described in prior embodiments except that lid 15 is constructed to have a lower profile. Combination roller unit 135 includes a housing 140 with a head plate 141 extending horizontally outwardly from the side of lid 15. Head plate 141 angles downwardly at its outboard edge to form a side plate section 142. A pair of spring-loaded, outer roller assemblies 143 are mounted to the underside, and at opposing ends of head plate 141 so that there is essentially a roller assembly 143 at each of the four corners of lid 15. Each roller-assembly 143 includes a downwardly opening, C-shaped mounting bracket 146, a roller mounting fork 147 pivotally mounted to one end of bracket 146, an end roller 148 rotatably mounted at pin 151 to fork 147, and a spring 149. Bracket 146 defines a downwardly extending spring-mounting portion 150 opposite the end where fork 147 is mounted. Fork 147 is pivotally mounted at its upper portion to bracket 146 via a pin 152. Fork 147 defines a pivot stop surface 154 which is configured to engage with the underside of bracket 146 and to permit fork 147 to pivot only outwardly (counterclockwise but not clockwise for the fork 147 on the right in FIG. 15) from its rest position (also shown in FIG. 15). Roughly midway between pin 151 and pin 152, and, like pins 151 and 152, third pin 155 is held by and between the arms 156 of fork 147. Spring 149 extends in tension between pin 155 and a pin 158 held by portion 150 to bias roller-mounting fork 147 to the rest position shown in FIG. 15**.

A spring-mounted, center roller assembly 159 is mounted to the underside of head plate 141, roughly midway between the outer two roller assemblies 143. Assembly 159 is similar in structure to the outer roller assemblies 143, except that it has pivotally mounted thereto a mirror image pair of roller mounting forks 160 and 161 configured to mutually or individually pivot only outwardly from their rest positions shown in FIG. 15. That is, fork 160 can pivot only clockwise and fork 161 can pivot only counterclockwise from the shown rest positions about their pivot pins 162 and 163, respectively. A spring 165 extends in tension between forks 160 and 161 at the spring mounting pins 166 and 167, respectively, to pull forks 160 and 161 together to their respective rest positions. Rollers 168 are rotatably mounted at the outboard ends of forks 160 and 161 by pins 169. Follower arm 170 is pivotally mounted at one end via pin 171 to the center roller bracket 172, pin 171 being between pins 162 and 163. Arm 170 includes an axle member 173 extending generally orthogonally outwardly therefrom. A follower roller 175 is rotatably mounted at the outboard end of axle member 173. Arm 170 is configured and mounted to bracket 172 so that roller 175 is roughly midway between rollers 168, as viewed in FIG. 15.

Rail 133 has an inverted, T-shaped cross-section and is fixedly mounted to the top 13 of container 10 just outside of opening 12 in a position aligned below the rollers 148 and 168 so that lid 15 will be centered over opening 12. The inverted T-shape of rail 133 is formed by a flat base plate 177 and a narrower-width guide bar 178 centeredly fixed thereatop. Each of rollers 148 and 168 is grooved to engage with and strictly follow the inverted, T-shape rail 133, as shown in FIG. 16.

Guide channel 134 has a hook-shaped cross-section and runs the width of container 10, alongside of rail 133. The long vertical 180, top horizontal 181 and inside short vertical 182 sides, which form the hook-shaped cross-section of channel 124, sufficiently enclose follower roller 175 so that roller 175, strictly follows channel 134 and rollers 148 and 168 strictly follow guide rails 133.

At each end of channel 134 is an end plate 183 fixedly connected thereto to constrain roller 175 to stay within guide channel 134, and not to roll outside of either end thereof. Braces 186 extend as needed between channels 22*a* and 22*c* and the corresponding housing 140 (as shown in FIG. 16) to provide support and more rigidly connect housings 140 to lid 15. Each brace 186 is welded to and extends generally from the junction of the channel portion 50 and rib portion 51 to the junction of head plate 141 and side plate section 142.

As with forks 147, follower arm 170 defines a pivot stop surface 185 at its top to constrain arm 170 to pivot only from the rest position (shown in FIGS. 15 and 16) counterclockwise (as viewed in FIG. 15). Because arm 170 cannot pivot (clockwise in FIG. 15) beyond its rest position, and because roller 175 cannot rise above the top horizontal side 181, lid 15 is precluded from rising farther than is shown in FIG. 15. Because springs 149 and 165 pull forks 147, 160 and 161 about their respective pins 152, 162 and 163, lid 15 is biased upwardly from container 10 and from sealing engagement with sealing flange 21, but only to the limited height permitted by the top side 181 via follower arm 170. When it is desired to close lid 15, the locking clamps 54 are engaged, as described in prior embodiments, to pull lid 15 into tight sealing engagement with container 10. When lid 15 is thus pulled onto container 10, forks 147, 160 and 161 pivot about their pins 152, 162 and 163, respectively, against the bias of their springs 149 and 165. When clamps 54 are released, springs 149 and 165 pull forks 147, 160 and 161 back to their rest positions (FIG. 15) to raise lid 15 clear of sealing flange 21. Lid 15 may then be pushed by one person parallel to guide rails 133, with rollers 148 and 168 strictly following guide rails 133.

Lid 15 pivots in a manner similar to the lid 15 of FIG. 1. When lid 15 is pushed or pulled to one side roughly one half its width, rollers 175 engage with and are stopped by the corresponding end plates 183 of guide channels 134. Lid 15 may then be pivoted, similarly to that shown in FIG. 1, about rollers 175 until lid 15 has rotated about 90° to its open position against the side of container 10.

In another embodiment shown in FIGS. 18 through 24, there is shown an intermodal container 210 with a sliding lid, side hinged, end-mounted dump door and swing away header in accordance with the preferred embodiment of this additional embodiment. Container 210 includes a container body 211 and a sliding lid 212 that is operable as described above and disclosed in FIGS. 15 through 17 to slide upon the top of container body 211 by virtue of a variety of rollers 215, mounted to lid 212, that roll upon guide rails 216, lid 212 being governed to slide to either side of container body 211 and then to pivot at the edge thereof to a vertically disposed, open position as described above and shown generally in FIGS. 1 and 14 by virtue of follower rollers riding within guide channels 214.

Container 210 is intermodal. That is, a single container 210 is configured to be transported by a number of different vehicles such as a truck, a train or a ship. Container 210 includes cast corner blocks 217, one at each of the eight corners of container body 211. When a number of containers such as container 210 are shipped together such as in the hold of a ship, it is desired to maximize the available space by arranging the containers as close to one another, both horizontally and vertically, as possible. When the containers are stacked side by side, end to end, or on top of each other, it is the blocks 217 of like size containers that come in contact with each other. All remaining components of the container must therefore lie within the planar boundaries of the eight corner blocks 217.

Container 210 includes an opening 219 (FIG. 21) at its rear end and a rear dump door 218 that is hingedly mounted thereto by a retractable hinge assembly 220 to cover the opening 219. Hinge assembly 220 includes three hinge units 221 that are all connected to and operated as a unit by a vertical link 222. Hinge units 221 are mutually identical, and only one will be described as follows, it being understood that its description refers equally to the other two units 221.

Figure 19:
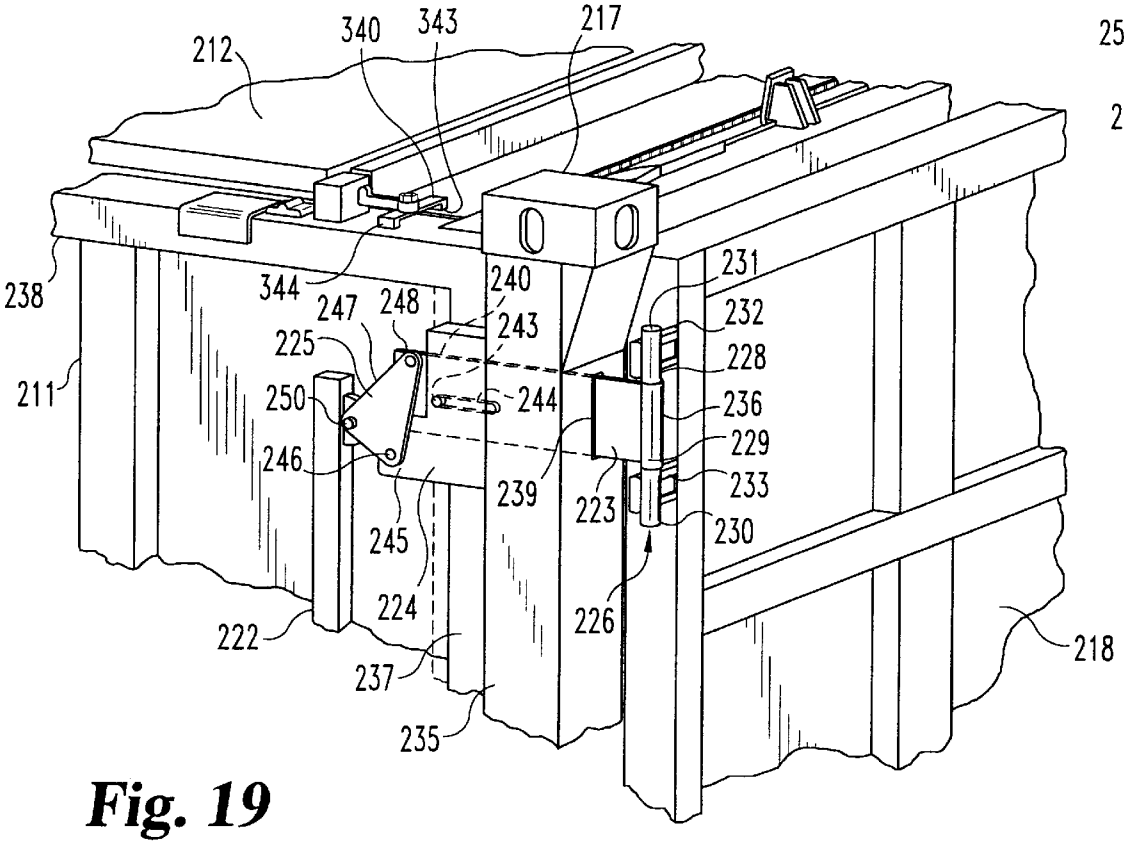
FIG. 19 is a fragmented, perspective view of the intermodal container of FIG. 18 showing the door in the unsealed and closed position.
Figure 21:
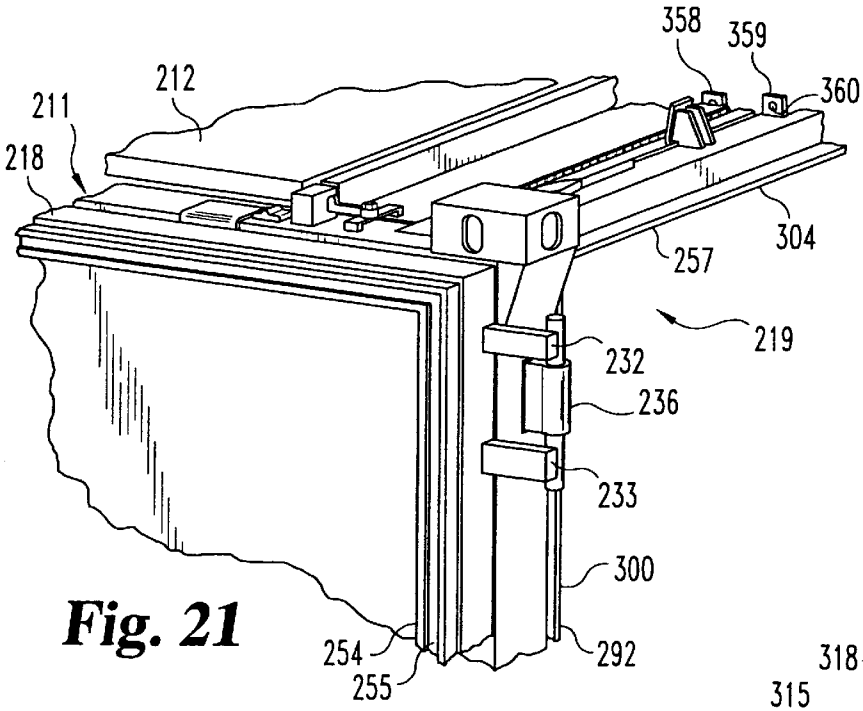
FIG. 21 is a fragmented perspective of the intermodal container of FIG. 19 showing door 218 in the fully opened position.

Referring to FIG. 19, hinge unit 221 includes a hinge link 223, a hinge cover plate 224, bell crank 225 and hinge 226. Hinge 226 includes upper, middle and lower cylinders 228, 229 and 230, respectively, and a hinge pin 231, which extends through and connects all three cylinders 228, 229 and 230 for mutually coaxial rotation. An upper connector arm 232 extends laterally from the left edge of door 218 and is rigidly connected tangentially to the outside of upper cylinder 228. Likewise, a lower connector arm 233 extends laterally from the left edge of door 218 and is rigidly connected tangentially to the outside of lower cylinder 230. Because arms 232 and 233 are connected tangentially to the outsides of cylinders 228 and 230, between hinge 226 and the corner frame member 235 of body 211, and because link 223 is connected tangentially to the outside of middle cylinder 229, between hinge 226 and door 218, door 218 can be rotated about pin 231 all the way around to and substantially flush with the side of container body 211, as shown in FIG. 21 and as will be described herein.

Figure 22:
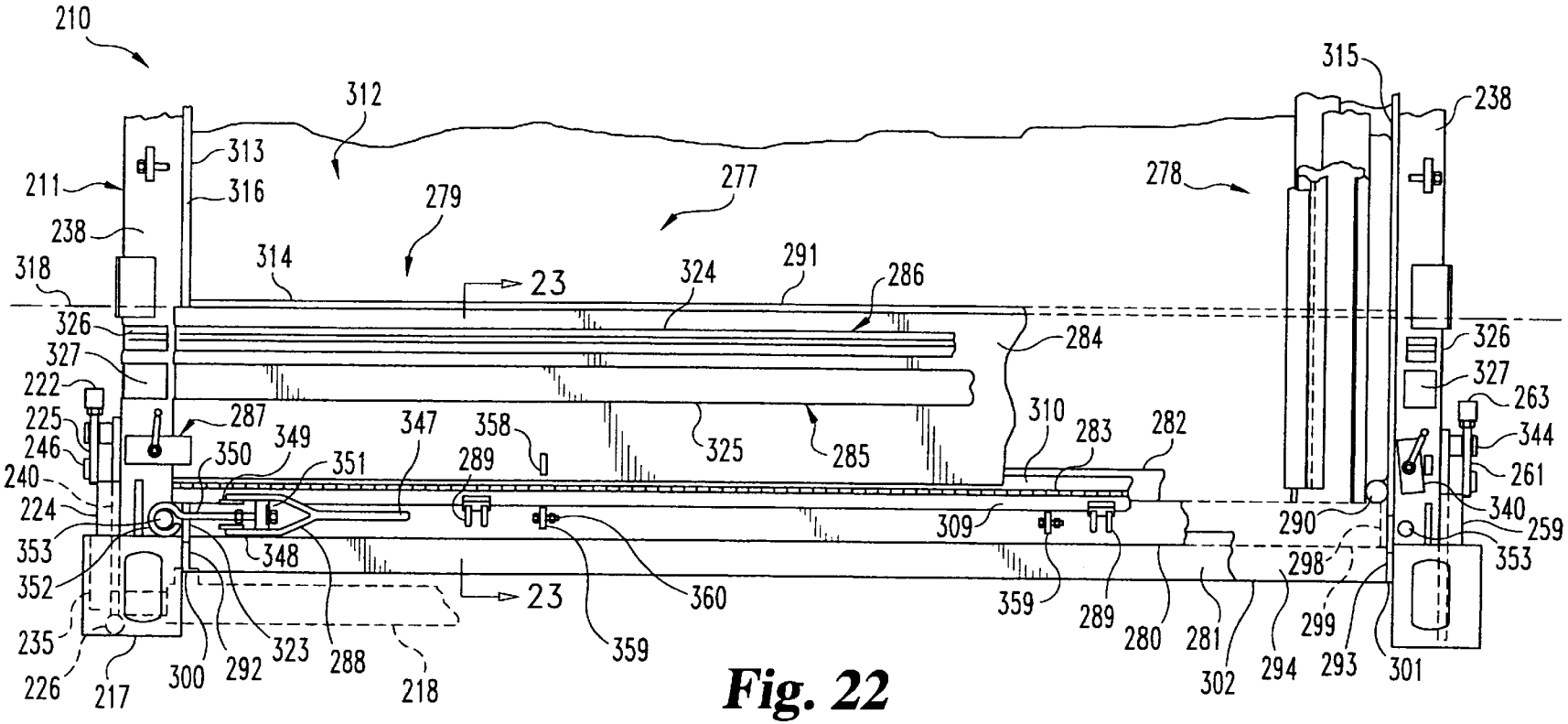
FIG. 22 is a plan view of the rear of the intermodal container of FIG. 18 showing on the left thereof swing-away header 277 in the transport position across the rear of container body 211 and with the right-side portions of swing-away header 277 broken away for purposes of description, and showing at the right side of FIG. 22 swing-away header 277 pivoted to the container loading position 278.

Referring to FIGS. 19 and 22, corner frame member 235 and cast corner block 217 extend outwardly from the rest of container body 211, and particularly from container body vertical frame member 237 and horizontal frame member 238. Hinge cover plate 224 is nested in the corner against and rigidly fixed to frame members 237 and 235. Frame member 235 is provided with a passageway 239, and cover plate 224 is provided with a passageway 240, these passageways being sized and configured to receive hinge link 223 for longitudinal, reciprocal movement therethrough. Passageway 240 is sized larger than hinge link 223, and cover plate 224 is provided with a fixed position follower pin 243. Hinge link 223 defines an elongate slot 244 through which extends pin 243. The front to back reciprocating movement of hinge link 223 is therefore defined by pin and slot arrangement 243 and 244, by passageway 239 and by the path of the pin 247 that pivotally connects bell crank 225 to link 223.

Triangular-shaped bell crank 225 is pivotally mounted at its three vertices: at pin 246 to a forwardly extending section 245 of cover plate 224; at pin 247 to the forward end 248 of hinge link 223; and at pin 250 to vertical link 222. Vertical link 222 is raised and lowered by a ratchet assembly 200 (FIG. 18) that is connected between an anchor plate 201 and a mounting plate 202. Plate 201 is rigidly connected to container body 211 and plate 202 is rigidly fixed to vertical link 222.

Figure 18:
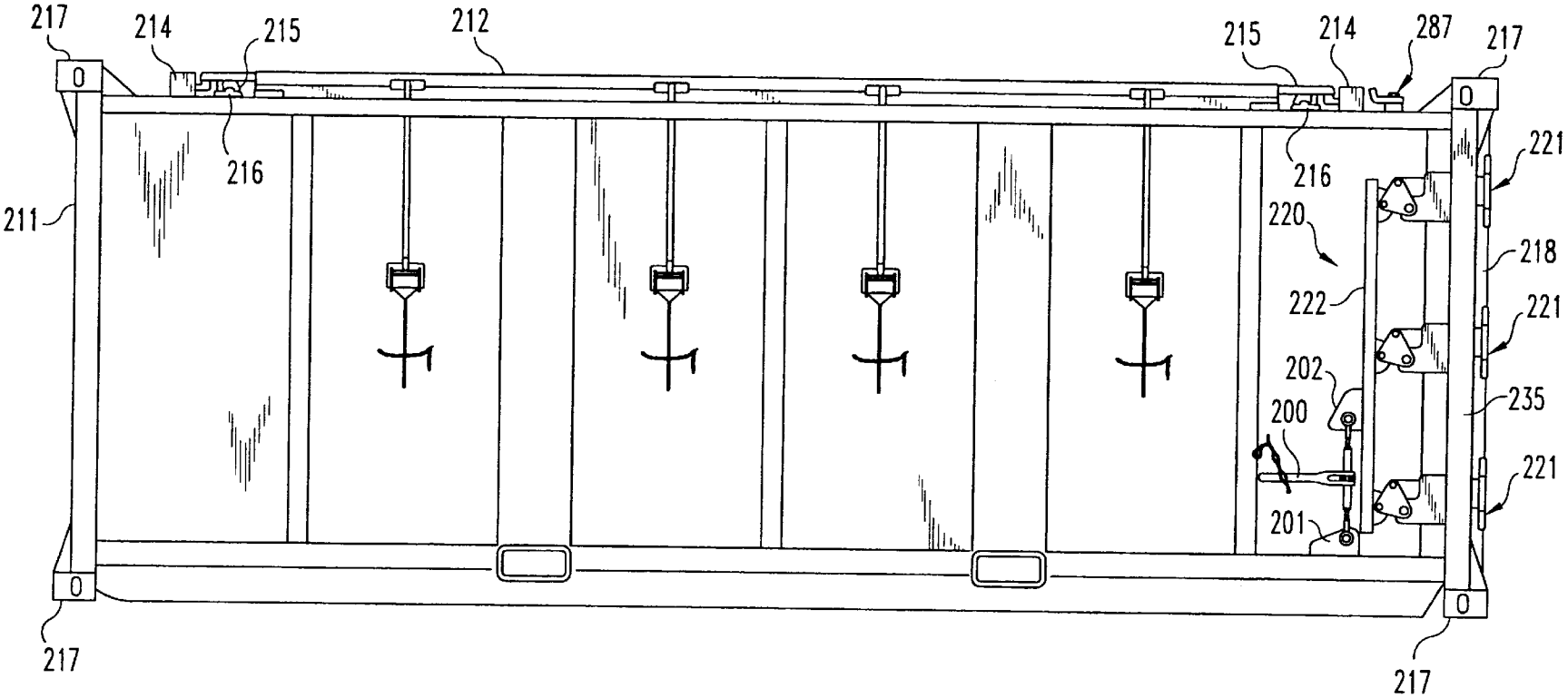
FIG. 18 is a side elevational view of an intermodal container with a side-hinged, end-mounted door, a large top-mounted, sliding lid, and swing-away header in accordance with the preferred embodiment of this embodiment of the invention and with door 218 shown retracted to the sealed and closed position.

Retractable hinge assembly 220 operates as follows:

As shown in FIG. 19, door 218 is in the closed and rearwardly extended position, and is ready to be swung open. As vertical link 222 is lowered by ratchet assembly 200, bell crank 225 is rotated counter-clockwise (as shown in FIG. 19) about stationery pin 246, which moves pin 247 and hinge link 223 and thus door 218 forwardly in a sealing relationship with container body 211 (as shown in FIG. 18), as will be described herein. Passageway 239 and pin and slot combination 243 and 244 are appropriately sized to account for the non-linear motion of pin 247 as bell crank 225 is rotated about pin 246. Other configurations of this assembly are contemplated to permit for the non-linear movement of pin 247 relative to hinge link 223.

When vertical link 222 is in the raised position (FIG. 19), door 218 is in the closed and rearwardly extended position and is ready to be swung open and, if door 218 is unlatched, it may be swung 270° about hinge pins 231 to a substantially flush position with the side of container body 211, as shown in FIG. 21. This is made possible because connector arms 232 and 233 are mounted tangentially to the outside of upper and lower cylinders 228 and 230, and because the rear end 236 of hinge link 223 is mounted tangentially to the exterior of middle cylinder 229. When door 218 is swung open, it completely clears the proximal corner blocks 217 and rests substantially flush against the side of container body 211, as shown in FIG. 21. Door 218 is provided with a sealing channel 254 that extends around the perimeter of door 218 on the side facing to the inside of container body 211 when door 218 is closed. Sealing channel 254 is similar in nature to channel 22*b* of the embodiment shown in FIG. 3 in that it includes a generally U-shaped cross-section that holds an appropriate sealing gasket material 255 so that when door 218 is pulled tightly against container body 211, gasket material 255 engages and forms a tight seal with a continuous, rectangular sealing flange 257 that surrounds the rear opening of container body 211.

Figure 20:
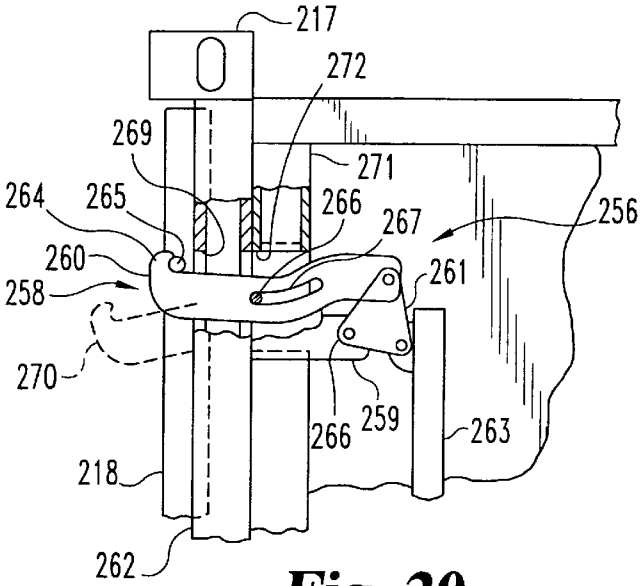
FIG. 20 is a side, fragmented view of the upper, right rear side of the intermodal container of FIG. 18 with the door pulled into the closed and sealed position.

Referring to FIGS. 20 and 22, at the right rear side of container body 211, on the side opposite retractable hinge assembly 220, container 210 includes a latching assembly 256 that operates separately from, but in conjunction with retractable hinge assembly 220 to pull door 218 tightly against the rear of container body 211 to enable the sealing relationship between gasket 255 and sealing flange 257. Like retractable hinge assembly 220, latch assembly 256 includes three identical latch units 258 (one shown), each latch unit 258 including a latch cover plate 259, a latch 260 and a bell crank 261. The bell cranks 261 of the three identical latch units 258 (one shown) are all connected to a vertical link 263 which is raised and lowered by a ratchet mechanism (not shown) like ratchet mechanism 200 on the opposite side of container body 211. Latch 260 has a shape substantially as shown in FIG. 20, the rearward end of latch 260 forming a hook 264 that is sized and configured to engage with a pin 265 that extends from the right edge of door 218. Like hinge link 223, latch 260 defines a slot 267 that receives a follower pin 268 that is rigidly connected to latch cover plate 259. Slot 267 of latch 260, however, is curved substantially as shown in FIG. 20 to provide the desired unlatching movement of latch 260 as will be described herein. Also, like bell crank 225 of hinge unit 221, bell crank 261 is pivotally connected at its three vertices by appropriate pins to a forwardly extending portion of latch cover plate 259, to the forward end of latch 260 and to vertical link 263.

Latch assembly 256 is shown in the latched position in FIG. 20 and operates as follows. When vertical link 263 is raised, bell crank 261 is caused to rotate about pin 266 which moves latch 260 rearwardly. As slot 267 follows pin 268, the rearward hook portion 264 of latch 260 moves rearwardly and downwardly to a release position (shown in phantom at 270) to both release door 218 therefrom and to allow door 218 to swing open without pin 265 then contacting hook portion 264 of latch 260. When door 218 is closed, vertical link 263 is lowered which reverses the process to move latch 260 forwardly so that hook portion 264 swings up to engage with pin 265 to pull door 218 and its sealing gasket 255 tightly against sealing flange 257. Latch assembly 256 and retractable hinge assembly 220 thus operate separately but work together to pull both sides of door 218 tightly against sealing flange 257 to effect a fluid tight closure of the opening 219 of container body 211. Just like the corner frame member 235 at the rear left corner of container body 211, container body 211 includes a corner frame member 262 at the right rear corner, proximal to latch assembly 256. Corner frame member 262 likewise has a passageway 269 to permit latch 260 to extend and move therethrough. As shown in FIG. 20, vertical container frame member 271 provides a passageway 272 which is covered by latch cover plate 259 and which provides, along with passageway 269, for the positionment and movement of latch 260. Alternatively, passageway 272 may be proceed directly by latch cover plate 259 alone.

Referring now to FIGS. 21 through 24, intermodal container 210 is provided with a swing-away header 277 which permits the use of sliding lid 212 with side-hinged, rear access door 218 and further enables header 277 to be pivoted from a closed, transport position 279 (FIG. 22) to a container loading position 278 off to one side of the inside of container body 211 (as shown in FIG. 22). Header 277 generally includes a crossbeam 280, a header sealing flange 281, an L-shaped support bracket 282, an elongate hinge 283, a headplate 284, guide channel 285, guide rail 286, hold-down clamps 287, tension clamps 288, easel supports 289, a hinge 290 and a lid sealing flange 291. Hinge 290 has a lower cylinder 295 that is fixedly secured to the right inner wall 293 of container body 211. Hinge 290 further includes an upper cylinder 297 that is mounted for coaxial rotation with respect to lower cylinder 295. A connection flange 298 extends outwardly from upper cylinder 297, and crossbeam 280 is rigidly connected at its right end 299 (as viewed in FIG. 22) to both connection flange 298 and upper cylinder 297 for rotation therewith about the axis of lower cylinder 295.

Container body 211 comprises a number of vertical frame members 237 (FIGS. 19 and 23), and horizontal frame members 238 (FIGS. 19, 22, 23 and 24). The interior of container body 211 is provided with left and right inner sidewalls 292 and 293, respectively, which comprise plates that are rigidly connected to the horizontal and vertical frame members 237 and 238. The interior of container body 211 is further provided with a floor 294, also connected to appropriate frame members (not shown). The rear edges 300 and 301 of left and right sidewalls 292 and 293, respectively, and the rear edge 302 of floor 294 together form a rearwardly facing, U-shaped sealing flange. This flange is made into a continuous, rectangular configuration by the pivotally removable addition of the header sealing flange 281 as will herein be described.

Header sealing flange 281 is rigidly connected to the bottom of crossbeam 280 so that when beam 280 spans the width of the rear of container body 211, the rear edge 304 of flange 281 resides in the same plane with the rear edges 300, 301 and 302 of side walls 292 and 293 and floor 294, respectively. Rear edges 300, 301, 302 and 309 together thereby form the continuous, rectangular sealing flange 257. The width of header sealing flange 281 is just slightly less than the distance between left and right walls 292 and 293 so that header 277 may easily be swung between the closed, transport position 279 and the container loading position.

Figure 23:
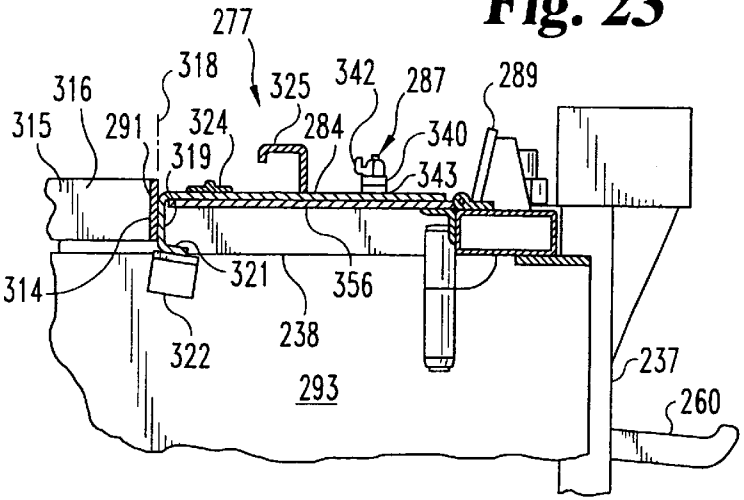
FIG. 23 is a fragmented, cross-sectional view of the intermodal container of FIG. 22 taken along the lines 22—22 and viewed in the direction of arrows and showing swing-away header 277 in the down, transport position.
Figure 24:
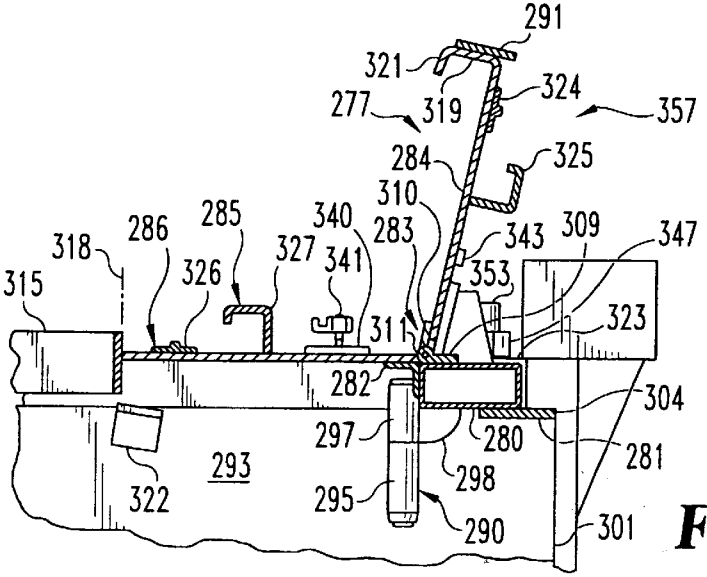
FIG. 24 is a fragmented, cross-sectional view of the intermodal container of FIG. 23 showing swing-away header 277 in the up position.

Elongate hinge 283 is similar to a piano hinge and has first and second hinge members 309 and 310 that are interconnected and pivot with respect to each other about hinge pin 311. First hinge member 309 is rigidly connected to the top of beam 280 as shown in FIGS. 22 through 24. Headplate 284 is in turn connected to the top of second hinge member 310 along its length, also shown in FIGS. 22 through 24. Hinge 283 is wide enough to extend from just inside right inner wall 293 to a position outside of left inner wall 292 and slightly over horizontal frame member 238, as shown.

Like the container body 11 described above and shown in FIGS. 1–3, container body 211 has an opening 312 in its top that is defined by four flat bar stock members (three shown—313, 314 and 315) that collectively form an upstanding rectangular sealing flange 316. The rear edges 317 of the opposing left and right bar stock members 313 and 315 define a plane 318, and headplate 284 extends from its connection at second hinge member 310 forwardly to plane 318 at which point headplate 284 angles downwardly approximately 90° to define flange mounting portion 319 (as shown in FIG. 22). Headplate 284 then angles rearwardly approximately 85° to define headplate support flange 321. Lid sealing flange 291 is rigidly fixed to the flange mounting portion 319 so that when headplate 284 is in the closed and locked position shown in FIG. 23, lid scaling flange 291 is juxtaposed along plane 318 between the opposing left and right bar stock bars 313 and 315, thereby comprising the rear, transverse bar stock member 314.

Support flange 282 is an elongate, L-shaped member rigidly connected to the forward side of cross beam 280. Support flange 282 provides support for the second hinge member 310 and, if desired, gasket material may be interposed between the top of support flange 282 and headplate 284 to better seal the interior of container 210.

The guide rails 133 and guide channels 134 of FIG. 16 are provided here as guide rail 286 and guide channel 285 except that, because both guide rail 286 and guide channel 285 extend across the entire width of container body 211, they are each interrupted with the intermediate segments, 324 and 325 of guide rail 286 and guide channel 285, respectively, being mounted to tile top of headplate 284. The remaining segments 326 and 327 of guide rail 286 and guide channel 285, respectively, are mounted on the top of horizontal frame members 238 as shown. Intermediate and outer segments 324, 325, 326 and 327 are sized and configured to form a substantially smooth and continuous guide rail 286 and guide channel 285 to produce a smooth and reliable sliding and pivoting movement of the container lid as described above. Headplate 284 is held tightly in the closed position (FIG. 23) by the pair of hold-down clamps 287 and the pair of tension clamps 288. Each hold-down clamp 287 includes a cross bar 340, a threaded post 341 that extends through a hole in the middle of bar 340 and fixedly into body frame member 238, a handle 342 that is threadedly received onto post 341, and clamping blocks. One clamping block 343 (FIGS. 23 and 24) projects upward from the top of headplate 284 and the other clamping block 344 projects upward from the top of frame member 238 (FIG. 22). When headplate 284 is in the closed position (FIG. 23), cross bar 340 is rotated about post 341 until it spans across both clamping blocks 343 and 344. Threaded handle 342 is then rotated about threaded post 341 to tighten down cross bar 340 and thereby securely lock headplate 284 in place.

There are two tension clamps 288, one on each side of tile rear of container 210 (one clamp 288 shown on the left side in FIG. 22) each tension clamp is a standard fulcrum lever arrangement whereby a handle 347 is pivotally mounted at 348 to upstanding brackets 349 on cross beam 280. An eyebolt 350 is threadedly mounted to a rod 351 which is pivotally mounted to handle 347 as shown. The eye 352 at the distal end of eyebolt 350 is sized to encircle a post 353 that extends upwardly from frame member 238. Eyebolt 350 may be extended or retracted from rod 351 so that when eye 352 is positioned over post 353, pivoting of handle 347 about pivot 348 pulls the eyebolt 350 relative to post 353 and draws the connecting structure, cross beam 280 against frame member 238. When the interconnected components, headplate 284, cross beam 280 and header sealing flange 281 are in the closed position of FIGS. 22 and 23, latching of tension clamps 288 draws left and right frame members 238 toward one another and forces the outer ends of header sealing flange 281 tightly against left and right inner sidewalls 292 and 293 thereby creating a firm continuous, rectangular sealing flange arrangement at 237. The top, rear portion of each sidewall 292 and 293 includes a raised, rectangular section 323 against which cross beam 280 is forced when tension clamps 288 are engaged. It is preferred that gasket material (not shown) be connected to the outer edges of cross beam 280 and header sealing flange 281 so that when tension clamps 288 are tightened, this gasket material will ensure a fluid tight seal between cross beam 280, header sealing flange 281 and the raised sections 323 of walls 292 and 293. Likewise, gasket material 356 is applied to the top of frame members 238 in position to provide a seal between headplate 284 and frame members 238 when headplate 284 is in the closed and locked position of FIG. 23.

There are two tension clamps 288, one on each side of the rear of container 210 (one clamp 288 shown on the left side in FIG. 22) each tension clamp is a standard fulcrum lever arangement whereby a handle 347 is pivotally mounted at 348 to upstanding brackets 349 on cross beam 280. An eyebolt 350 is threadedly mounted to a rod 351 which is pivotally mounted to handle 347 as shown. The eye 352 at the distal end of eyebolt 350 is sized to encircle a post 353 that extends upwardly from frame member 238. Eyebolt 350 may be extended or retracted from rod 351 so that when eye 352 is positioned over post 353, pivoting of handle 347 about pivot 348 pulls the eyebolt 350 relative to post 353 and draws the connecting structure, cross beam 280 against frame member 238. When the interconnected components, headplate 284, cross beam 280 and header sealing flange 281 are in the closed position of FIGS. 22 and 23, latching of tension clamps 288 draws left and right frame members 238 toward on another and forces the outer ends of header sealing flange 281 tightly against left and right inner sidewalls 292 and 293 therby creating a firm continuous, rectangular sealing flange arrangement at 257. The top, rear portion of each sidewall 292 and 293 includes a raised, rectangular section 323 against which cross beam 280 is forced when tension clamps 288 are engaged. It is preferred that gasket material (not shown) be connected to the outer edges of cross beam 280 and header sealing flange 281 so that when tension clamps 288 are tightened, this gasket material will ensure a fluid tight seal between cross beam 280, header sealing flange 281 and the raised sections 323 of walls 292 and 293. Likewise, gasket material 356 is applied to the top of frame members 238 in position to provide a seal between headplate 284 and frame members 238 when headplate 284 is in the closed and locked position of FIG. 23.

A headplate support bracket 322 is fixed to right side wall 293 and a similar bracket (not shown) is fixed to left side wall 292, these brackets 322 being positioned to support headplate 284 in the desired position as shown in FIG. 23.

When is is desired to enter a container 210, for example, with a forklift, swing away header 277 may be released from its closed and locked position of FIG. 23 to the container loading position 278 by first releasing tension clamps 288 and hold down clamps 287. Headplate 284 may then be pivoted about elongate hinge 283 to an up position 357 as shown in FIG. 24. Headplate 284 is supported in the up position 357 by the pair of easel supports 289 that are rigidly mounted to the top of cross beam 280. A pair of locking assemblies are provided to hold headplate 284 in the up position 357, each locking assembly including a first locking member 358 that projects upwardly from headplate 284 and a second locking member 359 that projects upwardly from cross beam 280. Locking members 358 and 359 each define a horizontaly extending hole 360 (FIG. 21) therethrough and are sized and configured so that when headplate 284 is pivoted to the up position 357, members 358 and 359 are juxtaposed side by side with their holes aligned. A locking pin may then be received therethrough and held within the aligned holes of the adjacent members 358 and 359, thereby preventing headplate 284 from pivoting back to the down position. Cross beam 280, header sealing flange 281 and headplate 284 may then be pivoted as a unit via hinge 290 to the container loading position 278 along the inner right side of container body 211. Headplate support bracket 322 is sized and configured so that cross beam 280 will rest atop support bracket 322 when header 277 is swung to the container loading position 278, this positionment being sufficient to prevent header 277 from swinging back across the opening before being desired to do so.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A waste handling container, comprising:

a container body having left and right sides, a rear, a top, an upwardly facing top opening in the top, and a rear opening in the rear;

a lid sized to cover said top opening and having a closed and clamped position tightly covering and sealing the top opening and an open position including said lid being vertically positioned along one side of said container body;

a lid control and support mechanism connected with said lid and said container to support said lid and to permit said lid to be slid and pivoted between the closed and clamped position and the open position;

a rear door hingedly connected along one side of said container to close off the rear opening; and, a retractable hinge assembly operable to retract said door tightly against the rear of said container body to seal the rear opening and to extend said door rearwardly to enable said door to be pivotally opened at said hinge assembly to a position alongside one side of said container body.

2. A waste handling container, comprising:

a container body having left and right sides, a rear, a top, an upwardly facing top opening defined in the top, and a rear opening defined in the rear;

a lid sized to cover said top opening and having a closed and clamped position tightly covering and sealing the top opening and an open position including said lid being positioned along a first side of said container body;

a lid control and support mechanism connected with said lid and said container to support said lid and to permit said lid to be slid and pivoted between the closed and clamped position and the open position;

a rear door;

a hinge assembly connecting said door to said container to permit said door to move between a closed position covering the rear opening and an open position away from the rear opening, said hinge assembly operable to retract said door from the closed position to a sealing position sealing said door against the rear of said container body to sealingly close the rear opening; and, a header hingedly connected to a second side of said container body to swing between a closed, transport position where said header extends between the left and right container sides and a container loading position where said header rests alongside the second side of said container, said lid control and support mechanism including lid guiding components mounted to said header.

3. The waste handling container of claim 2 wherein the first side of said container is opposite the second side of said container.

4. The waste handling container of claim 2 wherein said container body includes a body sealing flange, and said header includes a header sealing flange, and wherein the closed, transport position includes the body scaling flange and the header scaling flange forming a substantially continuous sealing flange sealingly engagable with said rear door.

5. The waste handling container of claim 4 further including clamp means for drawing the left and right container sides tightly against said header.

6. The waste handling container of claim 4 further including clamp means for holding said header tightly against said container body.

7. The waste handling container of claim 4 wherein said header includes a crossbeam hingedly connected to the second side of said container and includes a headplate hingedly connected along a substantially horizontal axis to the crossbeam to pivot between a closed position and an up position.

8. The waste handling container of claim 7 wherein the lid guiding components are mounted to the headplate and include a section of guide rail and a section of guide channel sized and configured to engage with, support and guide said lid.

9. The waste handling container of claim 7 wherein said container body includes a top sealing flange, and said headplate includes a lid sealing flange, and wherein the closed, transport position includes the top sealing flange and the lid scaling flange forming a substantially continuous sealing flange sealingly engagable with said lid.

10. The waste handling container of claim 2 wherein said hinge assembly is operable to extend said door rearwardly from the sealing position to the closed position to enable said door to be swung to a position alongside said one side of said container body.

11. The waste handling container of claim 10 wherein said hinge assembly includes at least one hinge link slidably mounted to said container body and to which is mounted said rear door, and wherein slid hinge assembly further includes means mounted to said container body for slidably reciprocating the at least one hinge link between forward and rearward positions to move said rear door between the closed and sealing positions.

12. The waste handling container of claim 11 wherein there are three of the at least one hinge links.

13. The waste handling container of claim 11 wherein said hinge assembly includes a first hinge cylinder fixedly connected to the at least one hinge link and includes a second hinge cylinder having an axis and being mounted to coaxially rotate with the first hinge cylinder, and wherein said door is fixedly connected to the second hinge cylinder and is outside of a plane passing through the axis of the second hinge cylinder.

14. A method for loading articles into a container, comprising the steps of:

providing a waste handling container including:

a container body having left and right sides, a rear, a top, an upwardly facing top opening defined in the top, and a rear opening defined in the rear, a lid sized to cover said top opening and having a closed and clamped position tightly covering and sealing the top opening and an open position including said lid being positioned along a first side of said container body, a lid control and support mechanism connected with said lid and said container to support said lid and to permit said lid to be slid and pivoted between the closed and clamped position and the open position, a rear door, a hinge assembly connecting said door to said container to permit said door to move between a closed position covering the rear opening and an open position away from the rear opening, said hinge assembly operable to retract said door from the closed position to a sealing position sealing said door against the rear of said container body to sealingly close the rear opening, and a header hingedly connected to a second side of said container body to swing between a closed, transport position extending between the left and right container sides and a container loading position alongside the second side of said container, said lid control and support mechanism including lid guiding components mounted to said header;

moving said lid from the closed and clamped position to the open position along the first side of said container body;

extending said rear door from the sealing position to the closed position;

opening said rear door from the closed position to the open position away from the rear opening; and, swinging said header from the closed, transport position to the container loading position.

* * * * *